US011092162B2

(12) United States Patent
Ishii et al.

(10) Patent No.: US 11,092,162 B2
(45) Date of Patent: Aug. 17, 2021

(54) CENTRIFUGAL BLOWER

(71) Applicants: DENSO CORPORATION, Kariya (JP); SOKEN, INC., Nisshin (JP)

(72) Inventors: Fumiya Ishii, Kariya (JP); Shuzo Oda, Kariya (JP); Masanori Yasuda, Nisshin (JP)

(73) Assignees: DENSO CORPORATION, Kariya (JP); SOKEN, INC., Nisshin (JP)

( * ) Notice: Subject to any disclaimer, the term of this patent is extended or adjusted under 35 U.S.C. 154(b) by 434 days.

(21) Appl. No.: 16/078,509

(22) PCT Filed: Feb. 9, 2017

(86) PCT No.: PCT/JP2017/004780
§ 371 (c)(1),
(2) Date: Aug. 21, 2018

(87) PCT Pub. No.: WO2017/145780
PCT Pub. Date: Aug. 31, 2017

(65) Prior Publication Data

US 2019/0093665 A1 Mar. 28, 2019

(30) Foreign Application Priority Data

Feb. 24, 2016 (JP) ..... JP2016-033497

(51) Int. Cl.
*F04D 29/22* (2006.01)
*F04D 29/16* (2006.01)
(Continued)

(52) U.S. Cl.
CPC ..... *F04D 29/2261* (2013.01); *F04D 17/16* (2013.01); *F04D 29/16* (2013.01);
(Continued)

(58) Field of Classification Search
CPC ..... F04D 29/16; F04D 29/2261; F04D 29/28; F04D 29/281; F04D 29/4226; F04D 17/16
See application file for complete search history.

(56) References Cited

U.S. PATENT DOCUMENTS 5,352,089 A 10/1994 Tokunaga et al.
5,511,939 A 4/1996 Tokunaga et al.
(Continued)

FOREIGN PATENT DOCUMENTS

JP S62061927 U 4/1987
JP 2940751 B2 8/1999
(Continued)

*Primary Examiner* — Woody A Lee, Jr.
(74) *Attorney, Agent, or Firm* — Harness, Dickey & Pierce, P.L.C.

(57) ABSTRACT

A centrifugal blower includes: a centrifugal fan, which includes a shroud ring; and a case. The case includes a cover portion that covers a surface of the shroud ring located on one side in an axial direction. The cover portion includes a recess formed in a cover opposing surface, which is opposed to the shroud ring, and the recess is shaped in a form of a circle. The shroud ring includes at least one projection that is formed in a ring opposing surface, which is opposed to the cover portion. A gap is formed between the cover portion and the shroud ring. A shortest distance between a radially inner end part of the shroud ring and the cover portion is set to be larger than a shortest distance between a surface of the projection and a surface of the recess.

6 Claims, 9 Drawing Sheets

(51) Int. Cl.

| | |
|---|---|
| ***F04D 29/44*** | (2006.01) |
| ***F04D 29/28*** | (2006.01) |
| ***F04D 17/16*** | (2006.01) |
| ***F04D 29/42*** | (2006.01) |

(52) U.S. Cl.
CPC ..... *F04D 29/28* (2013.01); *F04D 29/281* (2013.01); *F04D 29/4226* (2013.01); *F04D 29/44* (2013.01)

(56) References Cited

U.S. PATENT DOCUMENTS

| | | | | |
|---|---|---|---|---|
| 6,755,615 | B2 * | 6/2004 | Chapman | F04D 29/023 415/206 |
| 10,288,085 | B2 * | 5/2019 | Kominami | F04D 29/663 |
| 2005/0226721 | A1 * | 10/2005 | Higashida | F04D 29/162 415/206 |
| 2008/0279681 | A1 * | 11/2008 | Eguchi | F04D 29/282 415/206 |
| 2012/0211205 | A1 * | 8/2012 | Eguchi | F04D 29/281 165/121 |
| 2012/0275915 | A1 | 11/2012 | Konishi et al. | |
| 2016/0264028 | A1 | 9/2016 | Kawashima et al. | |
| 2018/0020838 | A1 * | 1/2018 | Ishii | F04D 29/162 297/180.13 |
| 2018/0245601 | A1 * | 8/2018 | Hayamitsu | A47L 5/22 |
| 2018/0355882 | A1 * | 12/2018 | Ishii | F04D 29/281 |
| 2019/0055957 | A1 * | 2/2019 | Nakatani | F04D 29/281 |

FOREIGN PATENT DOCUMENTS

| | | | |
|---|---|---|---|
| JP | 2006307830 | A | 11/2006 |
| JP | 2009041542 | A | 2/2009 |
| JP | 2012229657 | A | 11/2012 |
| JP | 2015108369 | A | 6/2015 |

* cited by examiner

CENTRIFUGAL BLOWER

CROSS REFERENCE TO RELATED APPLICATIONS

This application is a U.S. National Phase Application under 35 U.S.C. 371 of International Application No. PCT/JP2017/004780 filed on Feb. 9, 2017 and published in Japanese as WO/2017/145780 A1 on Aug. 31, 2017. This application is based on and claims the benefit of priority from Japanese Patent Application No. 2016-033497 filed on Feb. 24, 2016. The entire disclosures of all of the above applications are incorporated herein by reference.

TECHNICAL FIELD

The present disclosure relates to a centrifugal blower.

BACKGROUND ART

The patent literature 1 discloses a centrifugal blower. This centrifugal blower includes a fan and a case. The fan includes a plurality of blades and a shroud ring. The shroud ring includes a projection that projects toward the case. A cover portion of the case, which covers the shroud ring, includes a recess that is formed in a surface of the cover portion, which is located on the shroud ring side. The projection of the shroud ring is placed in an inside of the recess. In this way, a labyrinthine structure is formed in a gap, which is formed between the shroud ring and the case. The labyrinthine structure reduces a flow rate of a backflow that flows in the gap formed between the shroud ring and the case. The backflow is an air flow that flows backward relative to a flow direction of a main flow of the air. The main flow is an air flow, which is generated by the fan and is directed from a radially inner side toward a radially outer side in a fan radial direction.

Furthermore, in this centrifugal blower, a distance between the shroud ring and the case is reduced from a radially outer end part toward a radially inner end part of the shroud ring. With this configuration, the flow rate of the backflow is further reduced. Therefore, in this prior art centrifugal blower, an improvement in a flow rate performance and a reduction in a noise level are possible.

CITATION LIST

Patent Literature

PATENT LITERATURE 1: JP2015-108369A

SUMMARY OF INVENTION

The inventors of the present application have studied a further improvement in the performance of the centrifugal blower. Thereby, the inventors of the present application have found the following disadvantage of the prior art centrifugal blower.

In the prior art centrifugal blower, a size of the gap between the shroud ring and the case is minimum at a radially inner end part of the shroud ring. Therefore, a flow velocity of the backflow, which is discharged from the gap between the shroud ring and the case, is increased. When the backflow, which has the high flow velocity, is merged with the main flow, which is formed by the fan, the main flow is separated from the shroud ring.

It is an objective of the present disclosure to provide a centrifugal blower that can reduce a flow rate of a backflow and limit separation of a main flow from a shroud ring.

According to the present disclosure, there is provided a centrifugal blower, in which a centrifugal fan is rotatable about a fan central axis to suction air in an axial direction of the fan central axis and discharge the suctioned air in a radial direction of the fan central axis, the centrifugal blower including:

the centrifugal fan that includes:

a plurality of blades that are circumferentially arranged one after another about the fan central axis; and a shroud ring that is shaped into a plate form and is connected to a part of each of the plurality of blades located on one side in the axial direction, wherein the shroud ring includes a fan suction hole that is configured to suction the air; and a case that receives the centrifugal fan and has a case suction hole that is located on the one side in the axial direction and is configured to suction the air, wherein:

the case includes a cover portion that covers a surface of the shroud ring, which is located on the one side in the axial direction;

the cover portion includes:

a cover opposing surface that is opposed to the shroud ring; and a recess that is formed in the cover opposing surface and is shaped in a form of a circle, which has a center positioned at the fan central axis;

the shroud ring includes:

a ring opposing surface that is opposed to the cover portion; and at least one projection that is formed in at least a part of a region of the ring opposing surface, which is opposed to the recess;

a gap is formed between the cover portion and the shroud ring in a state where the projection is placed in an inside of the recess; and a shortest distance between a radially inner end part of the shroud ring and the cover portion is set to be larger than a shortest distance between a surface of the projection and a surface of the recess.

In this centrifugal blower, the projection is placed in the inside of the recess, so that a labyrinthine structure is formed in a gap between the cover portion and the shroud ring. In this way, it is possible to increase a pressure loss at the time of passing the air through this gap. Thus, with this centrifugal blower, it is possible to reduce the flow rate of the backflow that passes through this gap.

Furthermore, in this centrifugal blower, the shortest distance between the radially inner end part of the shroud ring and the cover portion is set to be larger than the shortest distance between the surface of the projection and the surface of the recess. Thereby, even when the velocity of the backflow of the air in the forming range of the labyrinthine structure is increased, the velocity of the backflow of the air at the radially inner end part of the shroud ring can be reduced. Therefore, with this centrifugal blower, it is possible to limit the separation of the main flow from the shroud ring.

DESCRIPTION OF EMBODIMENTS

Hereinafter, embodiments of the present disclosure will be described with reference to the drawings. In the following embodiments, the same or equivalent parts are denoted by the same reference signs.

First Embodiment

Figure 1:
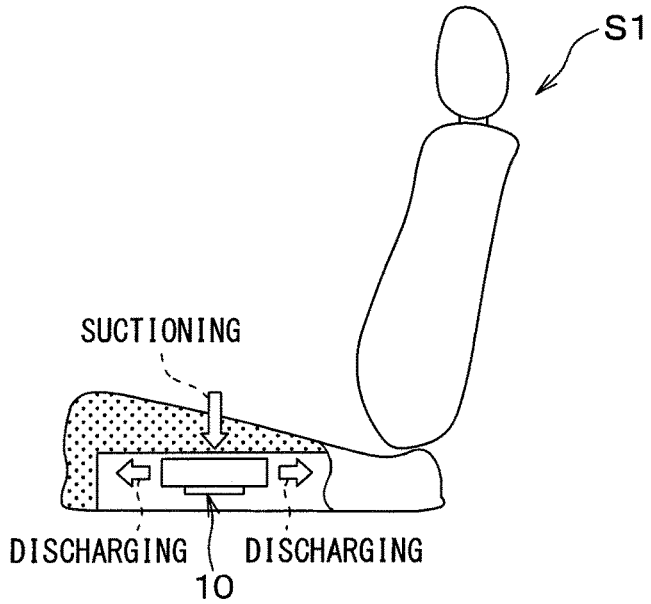
FIG. 1 is a cross-sectional view of a vehicle seat, at which a centrifugal blower according to a first embodiment is placed.

As shown in FIG. 1, a blower 10 of the present embodiment is used in a seat air conditioning device of a vehicle. The blower 10 is received in an inside of a seat S1, on which an occupant of the vehicle is seated. The blower 10 suctions the air through an occupant side surface of the seat S1. The blower 10 discharges the air at the inside of the seat S1. The air, which is discharged from the blower 10, is discharged from a portion of the seat S1, which is other than the occupant side surface of the seat S1.

Figure 2:
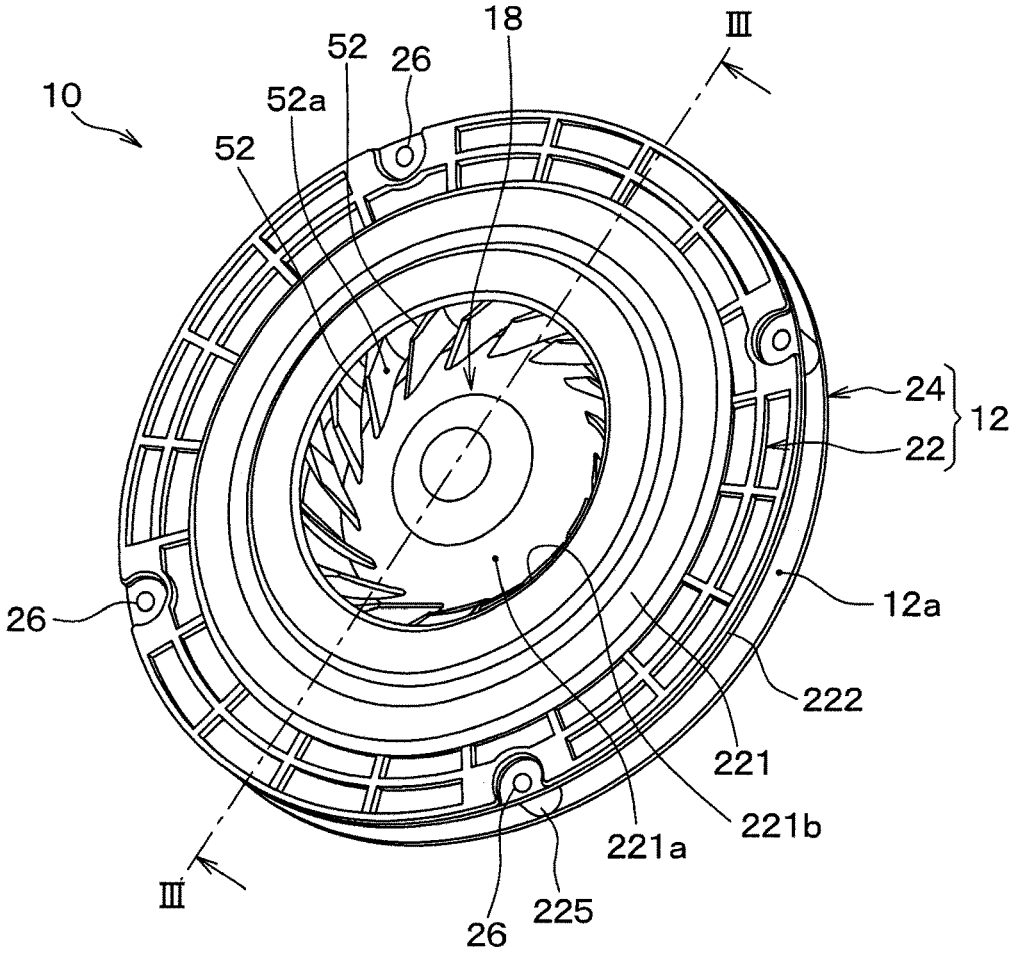
FIG. 2 is a perspective view showing an exterior of the centrifugal blower according to the first embodiment.
Figure 3:
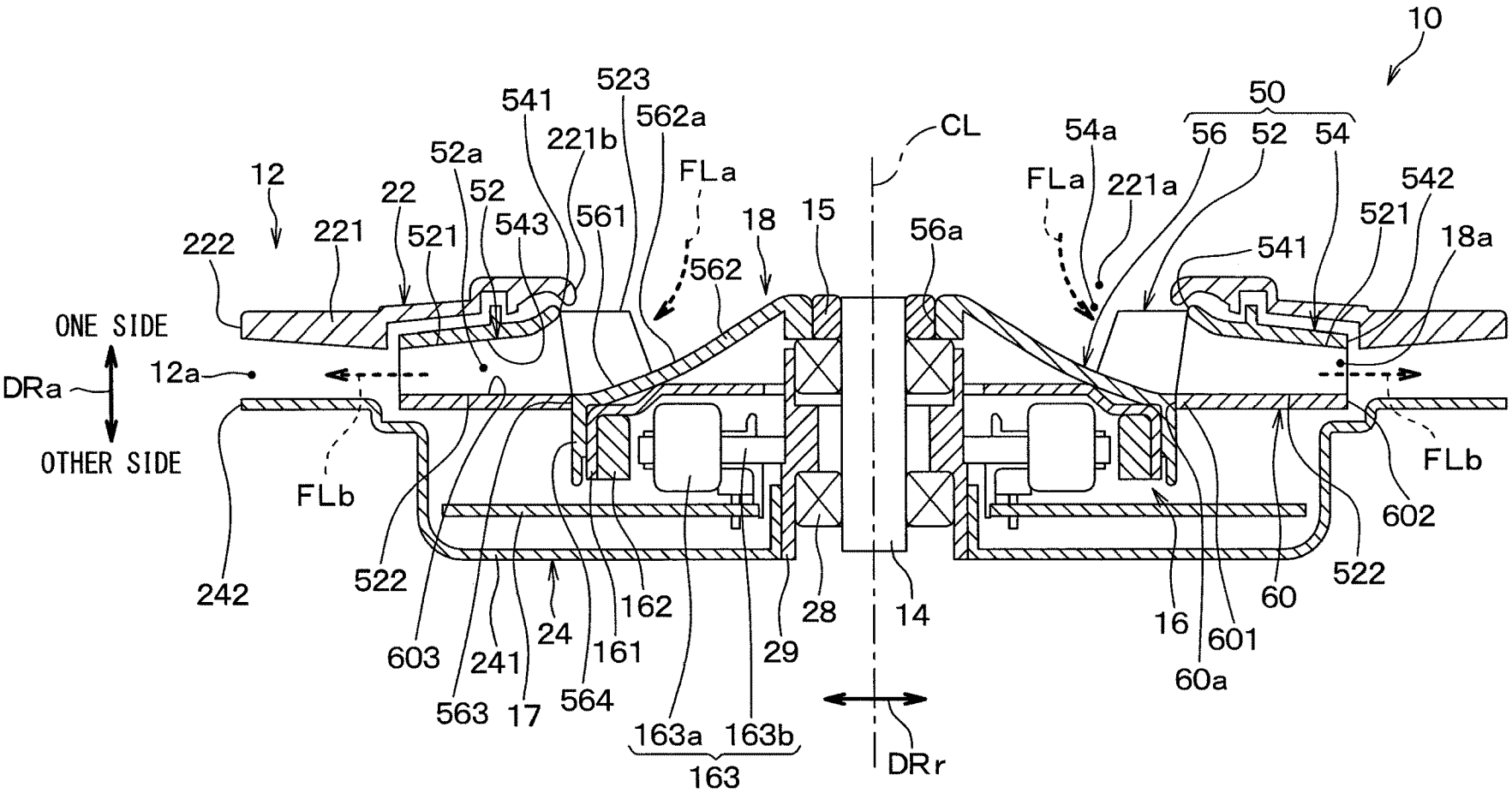
FIG. 3 is a cross-sectional view taken along line III-III in FIG. 2.

As shown in FIGS. 2 and 3, the blower 10 is a centrifugal blower, more specifically a turbo blower. FIG. 3 is an axial cross-sectional view of the blower 10 taken along a plane that includes a fan central axis CL. FIG. 3 indicates an axial direction DRa of the fan central axis CL, i.e., a fan axial direction DRa. Furthermore, an arrow DRr of FIG. 3 indicates a radial direction DRr of the fan central axis CL, i.e., a fan radial direction DRr.

The blower 10 includes a case (serving as a housing of the blower 10) 12, a rotatable shaft 14, a rotatable shaft housing 15, an electric motor 16, an electronic circuit board 17, a turbofan 18, a bearing 28 and a bearing housing 29.

The case 12 receives the electric motor 16, the electronic circuit board 17 and the turbofan 18. The case 12 includes a first case member 22 and a second case member 24.

The first case member 22 is made of resin. The first case member 22 is shaped into a generally circular plate form and has an outer diameter that is larger than an outer diameter of the turbofan 18. The first case member 22 includes a first cover portion 221, a first periphery portion 222 and a plurality of support pillars 225 shown in FIG. 2.

The first cover portion 221 is placed on one side of the turbofan 18 in the fan axial direction DRa. The first cover portion 221 covers a surface of the shroud ring 54, which is located on the one side in the fan axial direction DRa. Therefore, in the present embodiment, the first cover portion 221 serves as a cover portion that covers the surface of the shroud ring on the one side in the axial direction.

An air suction inlet 221*a* is formed at an inner peripheral side of the first cover portion 221. The air suction inlet 221*a* is a through-hole that extends through the first cover portion 221 in the fan axial direction DRa. The air is suctioned into the turbofan 18 through the air suction inlet 221*a*. Therefore, in the present embodiment, the air suction inlet 221*a* serves as a case suction hole that is formed on the one side in the fan axial direction DRa and suctions the air.

Furthermore, the first cover portion 221 includes a bell mouth portion 221*b* that forms a periphery of the air suction inlet 221*a*. The bell mouth portion 221*b* smoothly guides the air to be suctioned from an outside of the blower 10 to the air suction inlet 221*a* to the air suction inlet 221*a*.

The first periphery portion 222 forms a periphery of the first case member 22 around the fan central axis CL. Each of the support pillars 225 projects from the first cover portion 221 toward an inside of the case 12 in the fan axial direction DRa. Furthermore, each of the support pillars 225 is in a form of a cylindrical tube that has a thick wall and has a central axis that is parallel with the fan central axis CL. A screw hole 26, which receives a screw that connects between the first case member 22 and the second case member 24, is formed in an inside of each of the support pillars 225.

Each of the support pillars 225 of the first case member 22 is placed on a radially outer side of the turbofan 18 in the fan radial direction DRr. The first case member 22 and the second case member 24 are joined together by the screws, which are respectively inserted through the support pillars 225, in a state where a tip end of each of the support pillars 225 abuts against the second case member 24.

The second case member 24 is formed in a generally circulate plate form that has an outer diameter, which is substantially the same as an outer diameter of the first case member 22. The second case member 24 is made of resin. Alternatively, the second case member 24 may be made of metal, such as iron or stainless steel.

As shown in FIG. 3, the second case member 24 also functions as a motor housing, which covers the electric motor 16 and the electronic circuit board 17. The second case member 24 includes a second cover portion 241 and a second periphery portion 242.

The second cover portion 241 is placed on the other side of the turbofan 18 and the electric motor 16 in the fan axial direction DRa. The second cover portion 241 covers the other side of the turbofan 18 and the electric motor 16. The second periphery portion 242 forms a periphery of the second case member 24 around the fan central axis CL.

The first periphery portion 222 and the second periphery portion 242 form an air discharge portion of the case 12 that discharges the air. The first periphery portion 222 and the second periphery portion 242 form an air discharge outlet 12*a* that is formed between the first periphery portion 222 and the second periphery portion 242 in the fan axial direction DRa and discharges the air. The air discharge outlet 12*a* is formed at a fan side surface of the blower 10 and opens along a generally entire circumference of the case 12 about the fan central axis CL.

Each of the rotatable shaft 14 and the rotatable shaft housing 15 is made of metal, such as iron, stainless steel or brass. The rotatable shaft 14 is a rod material that is shaped into a cylindrical form. The rotatable shaft 14 is respectively press fitted to the rotatable shaft housing 15 and an inner race of the bearing 28. Therefore, the rotatable shaft housing 15 is fixed relative to the rotatable shaft 14 and the inner race of the bearing 28. Furthermore, an outer race of the bearing 28 is fixed to the bearing housing 29 by, for example, press fitting. The bearing housing 29 is made of metal, such as aluminum alloy, brass, iron, stainless steel or the like. The bearing housing 29 is fixed to the second cover portion 241.

Therefore, the rotatable shaft 14 and the rotatable shaft housing 15 are supported relative to the second cover portion 241 through the bearing 28. Specifically, the rotatable shaft 14 and the rotatable shaft housing 15 are rotatable relative to the second cover portion 241 about the fan central axis CL.

The rotatable shaft housing 15 is fitted to an inner peripheral hole 56*a* of the fan boss portion 56 of the turbofan 18 at the inside of the case 12. The rotatable shaft 14 and the rotatable shaft housing 15 are fixed together in advance and are then insert molded at a fan main body member 50 of the turbofan 18. Thereby, the rotatable shaft 14 and the rotatable shaft housing 15 are coupled non-rotatably relative the fan boss portion 56 of the turbofan 18. Specifically, the rotatable shaft 14 and the rotatable shaft housing 15 are rotated integrally with the turbofan 18 about the fan central axis CL.

The electric motor 16 is an outer rotor brushless DC motor. The electric motor 16 and the electronic circuit board 17 are placed between the fan boss portion 56 of the turbofan 18 and the second cover portion 241 in the fan axial direction DRa. The electric motor 16 includes a motor rotor 161, a rotor magnet 162 and a motor stator 163. The motor rotor 161 is made of metal, such as a steel plate. The motor rotor 161 is formed by press-forming the steel plate.

The rotor magnet 162 is a permanent magnet and is made of a rubber magnet that includes, for example, ferrite, neodymium, or the like. The rotor magnet 162 is fixed to the motor rotor 161. The motor rotor 161 is fixed to the fan boss portion 56 of the turbofan 18. The motor rotor 161 and the rotor magnet 162 are rotated integrally with the turbofan 18 about the fan central axis CL.

The motor stator 163 includes a stator coil 163*a*, which is electrically connected to the electronic circuit board 17, and a stator core 163*b*. The motor stator 163 is placed on the radially inner side of the rotor magnet 162 such that a small gap is interposed between the motor stator 163 and the rotor magnet 162. The motor stator 163 is fixed to the second cover portion 241 through the bearing housing 29.

In the electric motor 16, which is constructed in the above described manner, when an electric power is supplied from an external electric power source to the stator coil 163*a* of the motor stator 163, a magnetic flux change is generated at the stator core 163*b* by the stator coil 163*a*. The magnetic flux change at the stator core 163*b* generates an attractive force that attracts the rotor magnet 162. The motor rotor 161 is fixed relative to the rotatable shaft 14, which is rotatably supported by the bearing 28, so that the motor rotor 161 is rotated about the fan central axis CL by an attractive force that attracts the rotor magnet 162. That is, when the electric power is supplied to the electric motor 16, the electric motor 16 is rotated to rotate the turbofan 18, to which the motor rotor 161 is fixed, about the fan central axis CL.

The turbofan 18 is a centrifugal fan that is configured to blow the air when the turbofan 18 is rotated about the fan central axis CL in a predetermined fan rotational direction. Specifically, when the turbofan 18 is rotated about the fan central axis CL, the air is suctioned through the air suction inlet 221*a* from the one side in the fan axial direction DRa, as indicated by an arrow FLa. Then, the turbofan 18 discharges the suctioned air toward the radially outer side of the turbofan 18, as indicated by an arrow FLb.

Specifically, the turbofan 18 of the present embodiment includes the fan main body member 50 and an other-end-side plate 60. The fan main body member 50 includes a plurality of blades 52, a shroud ring 54 and a fan boss portion 56. The blades 52 are also referred to as fan blades. The fan main body member 50 is formed by a single injection molding by using resin. Therefore, the blades 52, the shroud ring 54 and the fan boss portion 56 are integrally formed in one piece from the common resin. Therefore, a coupling part for coupling between the blades 52 and the shroud ring 54 does not exist. Also, a coupling part for coupling between the blades 52 and the fan boss portion 56 does not exist.

The blades 52 are arranged one after another about the fan central axis CL. Specifically, the blades 52 are arranged one after another in a circumferential direction of the fan central axis CL while a gap, which conducts the air, is interposed between each adjacent two of the blades 52. As shown in FIG. 2, an inter-blade flow passage 52*a*, which conducts the air, is formed between each adjacent two of the blades 52.

As shown in FIG. 3, each blade 52 includes a one-side blade end part 521, which is located on the one side in the fan axial direction DRa, and an other-side blade end part 522, which is located on the other side that is opposite from the one side in the fan axial direction DRa.

Figure 4:
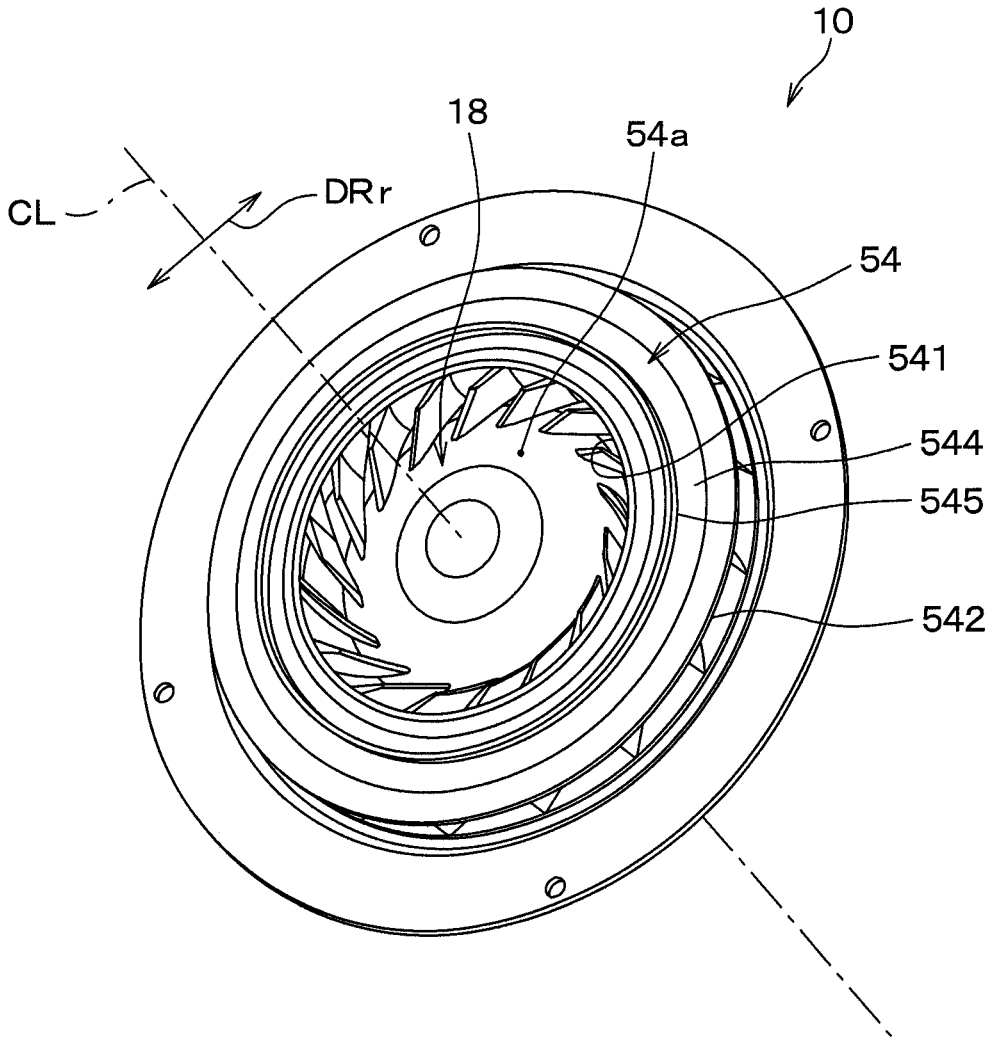
FIG. 4 is a perspective view of the centrifugal blower corresponding to FIG. 2 in a state where a first case member is removed.

As shown in FIGS. 3 and 4, the shroud ring 54 is shaped into a circular plate form that extends in the fan radial direction DRr. A fan suction hole 54*a* is formed at a radially inner side of the shroud ring 54. The air, which is introduced from the air suction inlet 221*a* of the case 12, is suctioned through the fan suction hole 54*a*, as indicated by the arrow FLa. Therefore, the shroud ring 54 is shaped into a ring form.

The shroud ring 54 includes a ring inner peripheral end part 541 and a ring outer peripheral end part 542. The ring inner peripheral end part 541 is a radially inner end part of the shroud ring 54 located on the radially inner side in the fan radial direction DRr. More specifically, the ring inner peripheral end part 541 is a tip end side part of the shroud ring 54 that includes a tip end of the shroud ring 54, which is located on the inner side in the fan radial direction DRr. The ring inner peripheral end part 541 forms the fan suction hole 54*a*. The ring outer peripheral end part 542 is a radially outer end part of the shroud ring 54 in the fan radial direction DRr.

As shown in FIG. 3, the shroud ring 54 is placed on the one side of the blades 52 in the fan axial direction DRa, i.e., the air suction inlet 221*a* side. The shroud ring 54 is joined to each of the blades 52. In other words, the shroud ring 54 is joined to the one-side blade end part 521 of each of the blades 52.

The fan boss portion 56 is fixed to the rotatable shaft 14, which is rotatable about the fan central axis CL, through the rotatable shaft housing 15. Therefore, the fan boss portion 56 is supported rotatably about the fan central axis CL relative to the case 12, which serves as a non-rotatable member of the blower 10.

Furthermore, the fan boss portion 56 is joined to each of the blades 52 on the opposite side that is opposite from the shroud ring 54. Specifically, a blade joint part 561 of the fan boss portion 56, which is joined to the respective blades 52, is entirely placed on the radially inner side of the shroud ring 54 in the fan radial direction DRr. Specifically, the fan boss portion 56 is joined to each of the blades 52 at a radially inner side region of the other-side blade end part 522. Therefore, each of the blades 52 also has a function of a joining rib that joins between the fan boss portion 56 and the shroud ring 54 to bridge between the fan boss portion 56 and the shroud ring 54. Therefore, the blade 52, the fan boss portion 56 and the shroud ring 54 can be integrally molded in one piece.

Furthermore, the fan boss portion 56 includes a boss guide surface 562*a* that guides an air flow in the inside of the turbofan 18. The boss guide surface 562*a* is a curved surface that extends in the fan radial direction DRr. The boss guide surface 562*a* guides the air flow, which is suctioned into the air suction inlet 221*a* and is directed in the fan axial direction DRa, toward the radially outer side in the fan radial direction DRr.

Specifically, the fan boss portion 56 has a boss guide portion 562 that includes the boss guide surface 562*a*. The boss guide portion 562 forms the boss guide surface 562*a* on the one side of the boss guide portion 562 in the fan axial direction DRa.

A inner peripheral hole 56*a*, which extends in the fan axial direction DRa, is formed at an inner peripheral side of the fan boss portion 56, to fix the fan boss portion 56 to the rotatable shaft 14.

The fan boss portion 56 includes a boss outer peripheral end part 563 and a ring-shaped extension part 564. The boss outer peripheral end part 563 is a radially outer end part of the fan boss portion 56 located on the radially outer side in the fan radial direction DRr. Specifically, the boss outer peripheral end part 563 is an end part that forms a periphery of the boss guide portion 562. The boss outer peripheral end part 563 is located on the radially inner side of the ring inner peripheral end part 541 in the fan radial direction DRr.

The ring-shaped extension part 564 is a cylindrical tubular rib and extends from the boss outer peripheral end part 563 toward the other side (i.e., the opposite side that is opposite from the air suction inlet 221*a*) in the fan axial direction DRa. The motor rotor 161 is fitted to and is received at an inner peripheral side of the ring-shaped extension part 564. Specifically, the ring-shaped extension part 564 functions as a rotor storage part that stores the motor rotor 161. When the ring-shaped extension part 564 is fixed to the motor rotor 161, the fan boss portion 56 is fixed to the motor rotor 161.

The other-end-side plate 60 is shaped into a circular plate form and extends in the fan radial direction DRr. A side plate fitting hole 60*a*, which extends through the other-end-side plate 60 in a thickness direction of the other-end-side plate 60, is formed at an inner peripheral side of the other-end-side plate 60. Therefore, the other-end-side plate 60 is shaped into a ring form. The other-end-side plate 60 is a resin molded product that is molded separately from the fan main body member 50.

In addition, the other-end-side plate 60 is joined to each of the other-side blade end parts 522 in a state where the other-end-side plate 60 is fitted to the radially outer side of the fan boss portion 56 that is located at the outer side in the fan radial direction DRr. The other-end-side plate 60 is joined to the blades 52 by vibration welding or thermal welding. Therefore, from the viewpoint of the weldability of the other-end-side plate 60 and the blades 52 by the welding, it is preferable that the material of the other-end-side plate 60 and the fan main body member 50 is thermoplastic resin, and more specifically, a common material is preferable.

By joining the other-end-side plate 60 to the blades 52 in this manner, the turbofan 18 is completed as a closed fan. The closed fan is a turbofan, in which two axially opposite sides of each inter-blade flow passage 52*a* defined between the corresponding adjacent two of the blades 52, are respectively covered by the shroud ring 54 and the other-end-side plate 60 in the fan axial direction DRa. Specifically, the shroud ring 54 includes a ring guide surface 543 which is exposed to each inter-blade flow passage 52*a* and guides the air flow in the inter-blade flow passage 52*a*. In addition, the other-end-side plate 60 includes a side plate guide surface 603 that is exposed to each inter-blade flow passage 52*a* and guides the air flow in the inter-blade flow passage 52*a*.

The side plate guide surface 603 is opposed to the ring guide surface 543 across the inter-blade flow passage 52*a* and is placed on the radially outer side of the boss guide surface 562*a* in the fan radial direction DRr. Furthermore, the side plate guide surface 603 has a function of smoothly guiding the air flow, which flows along the boss guide surface 562*a*, to a discharge outlet 18*a*. Therefore, the boss guide surface 562*a* and the side plate guide surface 603 respectively form one part and another part of a virtual curved surface, which is three-dimensionally curved. In other words, the boss guide surface 562*a* and the side plate guide surface 603 form one curved surface that is not bent at a boundary between the boss guide surface 562*a* and the side plate guide surface 603.

In addition, the other-end-side plate 60 includes a side plate inner peripheral end part 601 and a side plate outer peripheral end part 602. The side plate inner peripheral end part 601 is a radially inner end part of the other-end-side plate 60 in the fan radial direction DRr. The side plate inner peripheral end part 601 forms the side plate fitting hole 60*a*. The side plate outer peripheral end part 602 is a radially outer end part of the other-end-side plate 60 in the fan radial direction DRr.

The side plate outer peripheral end part 602 and the ring outer peripheral end part 542 are spaced apart from each other in the fan axial direction DRa. The side plate outer peripheral end part 602 and the ring outer peripheral end part 542 form the discharge outlet 18*a*, which discharges the air passed through each inter-blade flow passage 52*a*, at a location between the side plate outer peripheral end part 602 and the ring outer peripheral end part 542.

Furthermore, as shown in FIG. 3, each of the blades 52 includes a blade front edge part 523. The blade front edge part 523 is an end edge part of the blade 52 that is formed on an upstream side in a flow direction of the air, which flows along arrows FLa, FLb, i.e., a flow direction of a main flow of the air. The main flow is a flow of the air that flows in the inter-blade flow passage 52*a* after passing through the fan suction hole 54*a*. The blade front edge part 523 projects on the radially inner side of the ring inner peripheral end part 541 in the fan radial direction DRr. The blade front edge part 523 projects also on the radially inner side of the boss outer peripheral end part 563 in the fan radial direction DRr. In other words, the blade front edge part 523 is located on the radially inner side of both of the ring inner peripheral end part 541 and the boss outer peripheral end part 563 in the fan radial direction DRr. One end of the blade front edge part 523 is joined to the ring inner peripheral end part 541. The other end of the blade front edge part 523 is joined to the boss guide surface 562*a*.

In other words, the blade front edge part 523 extends from the ring inner peripheral end part 541 toward the radially inner side in the fan radial direction DRr. The blade front edge part 523 is joined to a part of the fan boss portion 56, which is located on the radially inner side of the boss outer peripheral end part 563 in the fan radial direction DRr.

The turbofan 18, which is configured in the above described manner, is rotated integrally with the motor rotor 161 in the fan rotational direction. Thereby, the blades 52 of the turbofan 18 give a momentum to the air. The turbofan 18 radially outwardly discharges the air from the discharge outlet 18*a*, which opens at the outer periphery of the turbofan 18. At this time, the air, which is suctioned from the fan suction hole 54*a* and is forced forward by the blades 52, i.e., the air, which is discharged from the discharge outlet 18*a*, is released to the outside of the blower 10 through the air discharge outlet 12*a* of the case 12.

Figure 5A:
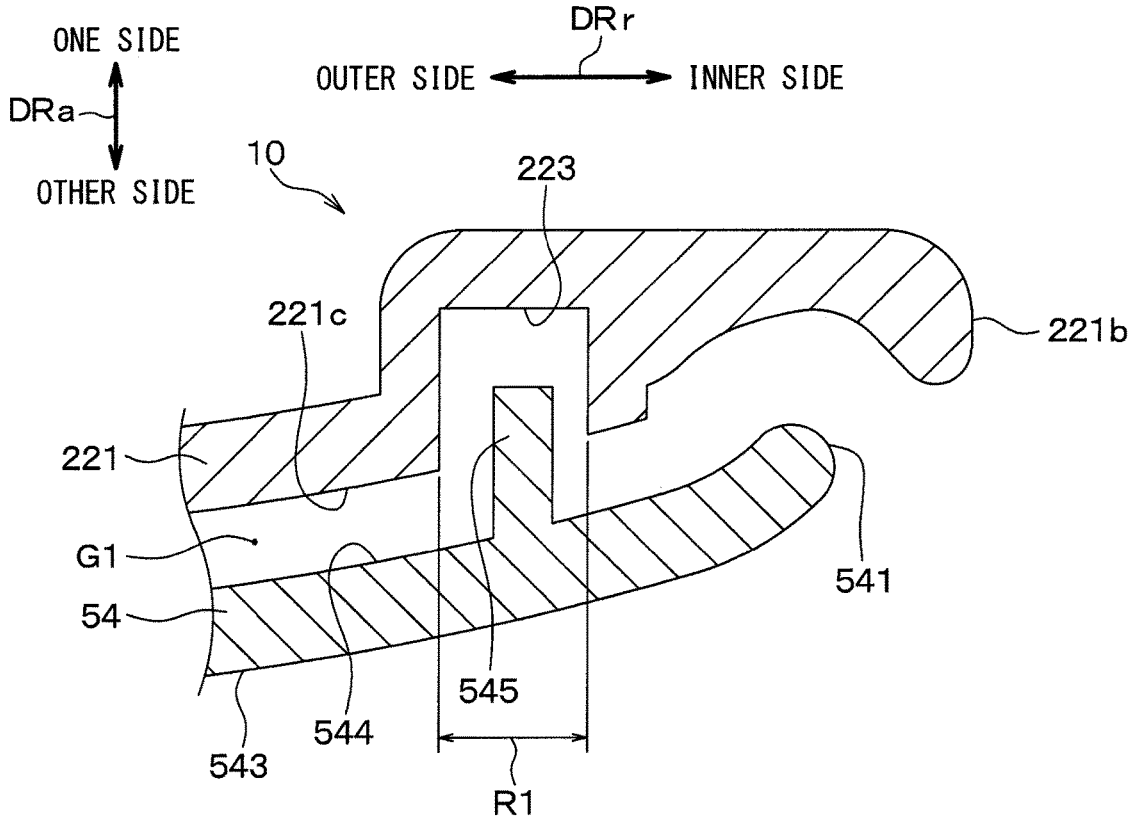
FIG. 5A is an enlarged cross-sectional view showing a first cover portion and a shroud ring of the centrifugal blower according to the first embodiment.
Figure 5B:
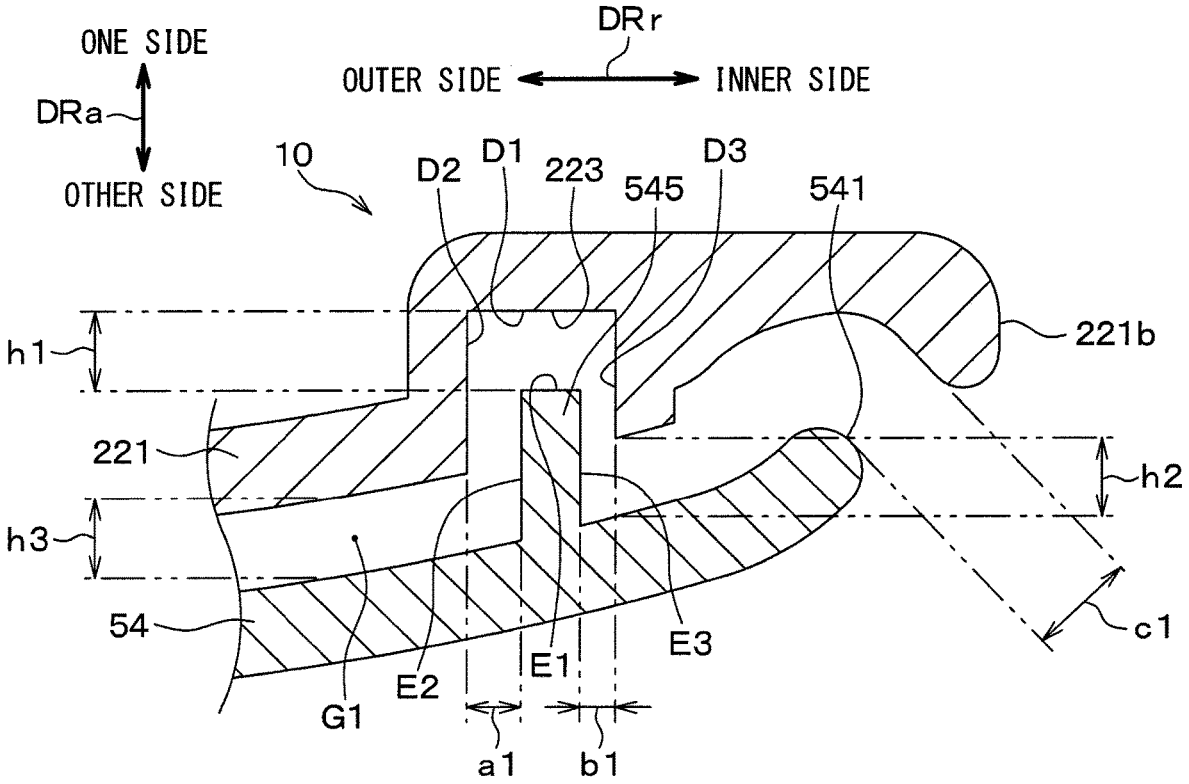
FIG. 5B is an enlarged cross-sectional view showing the first cover portion and the shroud ring of the centrifugal blower according to the first embodiment.

Next, with reference to FIGS. 5A and 5B, configurations of the first cover portion 221 and the shroud ring 54 will be described in detail. FIGS. 5A and 5B show identical sections of the first cover portion 221 and the shroud ring 54.

As shown in FIG. 5A, the first cover portion 221 includes a cover opposing surface 221*c* that is opposed to the shroud ring 54. Furthermore, the first cover portion 221 includes a single recess 223 that is formed in the cover opposing surface 221c. The recess 223 is shaped in a form of a circle, which has a center positioned at the fan central axis CL.

The shroud ring 54 includes a ring opposing surface 544 that is opposed to the first cover portion 221. Furthermore, the shroud ring 54 includes a single projection 545 that is formed at the ring opposing surface 544. The projection 545 is formed in a region of the ring opposing surface 544, which is opposed to the recess 223 in the fan axial direction DRa.

As shown in FIG. 4, the projection 545 is shaped in a form of a circle, which has a center positioned at the fan central axis CL. Therefore, the projection 545 is formed along an entire circumferential range of the region of the ring opposing surface 544, which is opposed to the recess 223.

As shown in FIG. 5A, a gap G1 is formed between the first cover portion 221 and the shroud ring 54 in a state where the projection 545 is placed in an inside of the recess 223. A labyrinthine structure is formed by placing the projection 545 in the inside of the recess 223. A range R1 of the gap G1, which is between the recess 233 and the region of the shroud ring 54 opposed to the recess 223 in the fan axial direction DRa, is a forming range R1 of the labyrinthine structure.

As shown in FIG. 5B, the recess 223 includes a bottom part D1, an outer peripheral surface D2 and an inner peripheral surface D3. The bottom part D1 is a part of the surface of the recess 223, which is closest to the one side in the fan axial direction DRa in comparison to the rest of the surface of the recess 223. The outer peripheral surface D2 is a radially outer surface part of the surface of the recess 223, which is located on the radially outer side of the bottom part D1 in the fan radial direction DRr. The inner peripheral surface D3 is a radially inner surface part of the surface of the recess 223, which is located on the radially inner side of the bottom part D1 in the fan radial direction DRr. A cross section of each of the bottom surface D1, the outer peripheral surface D2 and the inner peripheral surface D3 of the recess 223 is shaped into a linear form. Specifically, the bottom surface D1, the outer peripheral surface D2 and the inner peripheral surface D3 of the recess 223 are respectively formed as a planar surface.

The projection 545 includes a top part E1, an outer peripheral surface E2 and an inner peripheral surface E3. The top part E1 is a part of the projection 545, which is closest to the one side in the fan axial direction DRa in comparison to the rest of the projection 545. The outer peripheral surface E2 is a radially outer surface part of the surface of the projection 545, which is located on the radially outer side of the top part E1 in the fan radial direction DRr. The inner peripheral surface E3 is a radially inner surface part of the surface of the projection 545, which is located on the radially inner side of the top part E1 in the fan radial direction DRr. A cross section of each of the top part E1, the outer peripheral surface E2 and the inner peripheral surface E3 is shaped into a linear form. Specifically, the top part E1, the outer peripheral surface E2 and the inner peripheral surface E3 are respectively formed as a planar surface.

The gap G1 is formed to satisfy the following relational equations (1) and (2).

$$b1<a1<h1 \quad \text{Equation (1)}$$

$$b1<h2<c1 \quad \text{Equation (2)}$$

In the above equations, the reference sings a1, b1, c1, h1 and h2 respectively indicate distances shown in FIG. 5B. The reference sign a1 indicates a shortest distance between the outer peripheral surface E2 of the projection 545 and the outer peripheral surface D2 of the recess 223. In other words, the reference sign a1 indicates an outer shortest distance. The outer shortest distance is a shortest distance between a radially outer surface part of the surface of the projection 545, which is located on the radially outer side in the fan radial direction DRr, and the surface of the recess 223. The reference sign b1 indicates a shortest distance between the inner peripheral surface E3 of the projection 545 and the inner peripheral surface D3 of the recess 223. In other words, the reference sign a1 indicates an inner shortest distance. The inner shortest distance is a shortest distance between a radially inner surface part of the surface of the projection 545, which is located on the radially inner side in the fan radial direction DRr, and the surface of the recess 223. The reference sign h1 indicates a shortest distance between the top part E1 of the projection 545 and the bottom part D1 of the recess 223. In other words, the reference sign h1 indicates a shortest distance between the surface of the projection 545 and the surface of the recess 223 in the fan axial direction DRa. The reference sign h2 indicates a shortest distance between an inner peripheral edge part of the recess 223 of the first cover portion 221 and the shroud ring 54 in the fan axial direction DRa. In other words, the reference sign h2 indicates a shortest distance between the shroud ring 54 and the first cover portion 221 at an outlet of the labyrinthine structure. The reference sign c1 indicates a shortest distance between the ring inner peripheral end part 541 and the first cover portion 221.

A size of the gap G1 in a range between the recess 223 and the bell mouth portion 221*b* is set as follows. The size of the gap G1 in the range, which is from the recess 223 to a predetermined location on the radially inner side of the recess 223 in the fan radial direction Drr, is the distance h2 and is constant. The size of the gap G1 in a range from this predetermined location to the bell mouth portion 221*b* is the same as the shortest distance c1 and is constant.

Furthermore, the size of the gap G1 satisfies the following relational equation (3).

$$h1=h2=h3 \quad \text{Equation (3)}$$

Here, the reference sign h3 indicates a shortest distance between a part of the first cover portion 221, which is located on the radially outer side of the recess 223 in the fan radial direction DRr, and the shroud ring 54.

Figure 6:
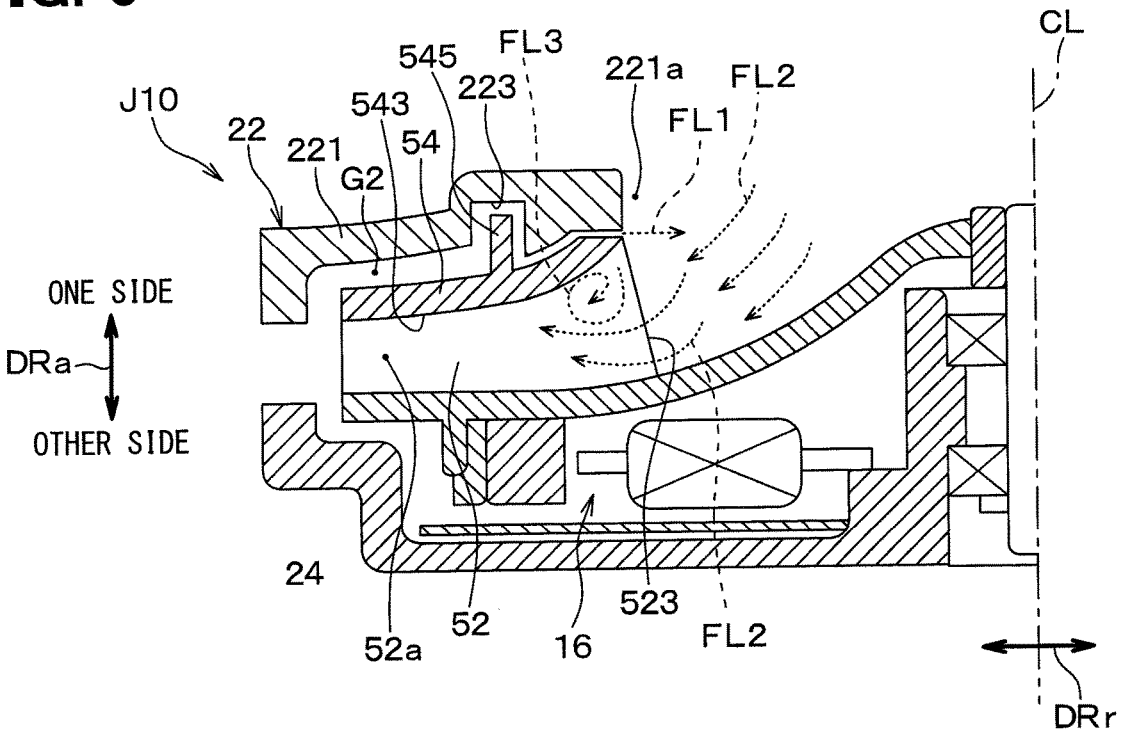
FIG. 6 is a cross-sectional view of a centrifugal blower in a first comparative example.

Next, the blower 10 of the present embodiment and a blower J10 of a first comparative example shown in FIG. 6 will be compared. The blower J10 of the first comparative example is the same as the blower 10 of the present embodiment with respect to that a gap G2 is formed between the first cover portion 221 and the shroud ring 54 in a state where the projection 545 is placed in the inside of the recess 223. The blower J10 of the first comparative example differs with respect to the gap G1 of the blower 10 of the present embodiment such that a size of the gap G2 is reduced from the radially outer side toward the radially inner side in the fan radial direction DRr. Furthermore, the blower J10 of the first comparative example differs from the blower 10 of the present embodiment with respect to that the blade front edge part 523 of each of the blades 52 is located on the radially outer side in comparison to the blower 10 of the present embodiment.

The blower 10 of the present embodiment and the blower J10 of the first comparative example both form the labyrinthine structure between the first cover portion 221 and the shroud ring 54 by positioning the projection 545 at the inside of the recess 223. In this way, it is possible to increase a pressure loss at the time of passing the air through the gap G1, G2. Therefore, both of the blower 10 of the present embodiment and the blower J10 of the first comparative example can reduce a flow rate of a backflow F1, which is an air flow that passes through the gap G2 from the radially outer side to the radially inner side in the fan radial direction DRr, in comparison to a case where the labyrinthine structure is absent.

However, in the blower J10 of the first comparative example, the size of the gap G2 is minimized at the tip end of the shroud ring 54, which is located on the inner side in the fan radial direction DRr. Therefore, a flow velocity of the backflow FL1, which is discharged from the gap G2 is increased. When the backflow FL1, which has the high flow velocity, merges with the main flow FL2 of the turbofan 18, the main flow FL2 is separated from the ring guide surface 543. Furthermore, a vortex FL3 is generated at a location that is adjacent to the ring guide surface 543.

With respect to the above points, the blower 10 of the present embodiment satisfies the relational equation (2) discussed above. Here, as indicated by the relational equation (1), the reference sign b1 indicates the shortest distance between the surface of the projection 545 and the surface of the recess 223. Therefore, in the blower 10 of the present embodiment, the shortest distance h2 between the shroud ring 54 and the first cover portion 221 at the outlet of the labyrinthine structure is set to be larger than the shortest distance b1 between the surface of the projection 545 and the surface of the recess 223 at the outlet of the labyrinthine structure. Furthermore, the shortest distance c1 between the ring inner peripheral end part 541 and the first cover portion 221 is set to be larger than the shortest distance h2 at the outlet of the labyrinthine structure. Specifically, in the blower 10 of the present embodiment, the size of the gap G1 is minimized in the forming range R1 of the labyrinthine structure. The size of the gap G1 is increased in a stepwise manner in the forming range R1 of the labyrinthine structure, the outlet of the labyrinthine structure and the outlet of the backflow in this order.

Thereby, even when the velocity of the backflow FL1 of the air in the forming range R1 of the labyrinthine structure is increased, the velocity of the backflow FL1 of the air at the tip end of the shroud ring 54, which is located on the inner side in the fan radial direction DRr, can be reduced.

Unlike the blower 10 of the present embodiment, if the size of the gap G1 is set to satisfy the relationship of h2=c1, the range, in which the size of the gap G1 is the distance c1, is increased, and thereby the reducing effect for reducing the backflow is deteriorated. In comparison to this, in the blower 10 of the present embodiment, the size h2 of the gap G1 at the predetermined location between the projection 545 and the ring inner peripheral end part 541 is set to be larger than the shortest distance b1 and smaller than the shortest distance c1. Thereby, the flow rate of the backflow can be reduced in comparison to the case where the size of the gap G1 is set to satisfy the relationship of h2=c1.

Figure 7:
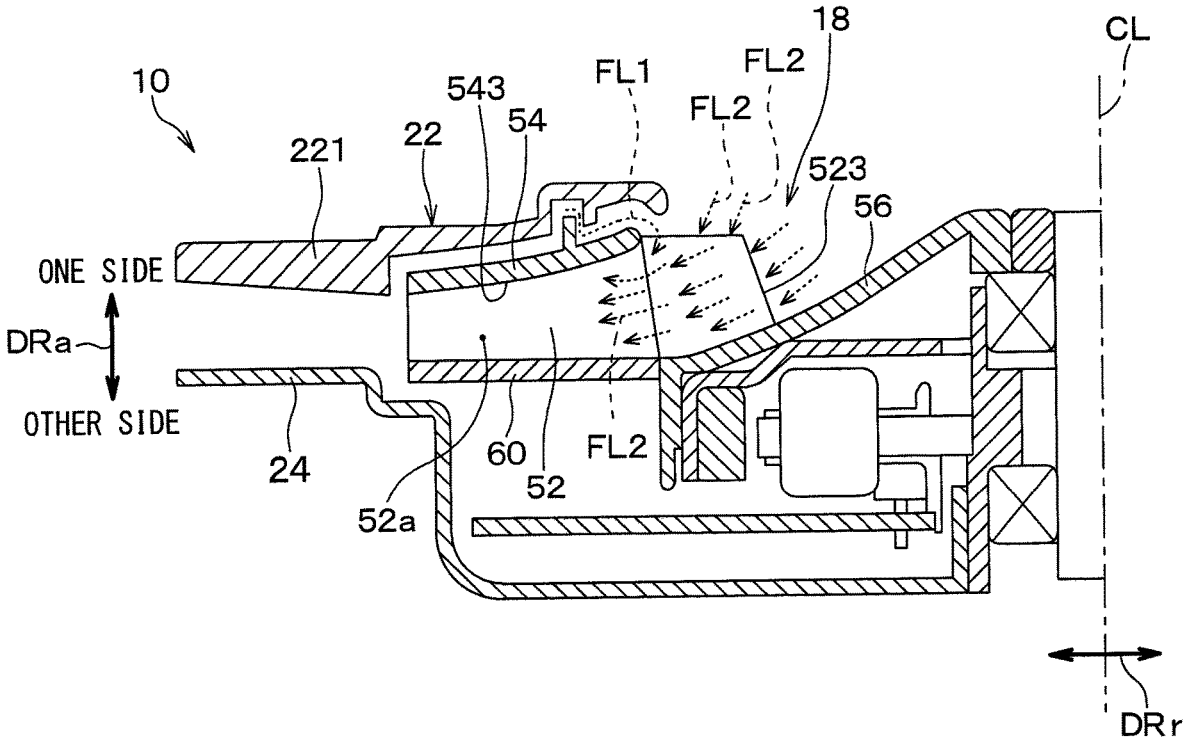
FIG. 7 is a cross-sectional view of the centrifugal blower according to the first embodiment.

Therefore, as shown in FIG. 7, in the blower 10, it is possible to limit the separation of the main flow FL2 from the ring guide surface 543. Furthermore, in the blower 10, it is possible to limit the generation of the vortex FL3 at the location adjacent to the ring guide surface 543.

Thus, in the blower 10 of the present embodiment, it is possible to limit the separation of the main flow FL2 from the ring guide surface 543 while the flow rate of the backflow FL1 is reduced.

Furthermore, in the blower 10 of the present embodiment, the size of the gap G1 satisfies the relational equation (1). As a result, the shortest distance h1 between the projection 545 and the recess 223 in the fan axial direction DRa is set to be larger than each of the shortest distances a1, b1 between the projection 545 and the recess 223 in the fan radial direction DRr.

At manufacturing of the blower 10, the multiple components are assembled to the rotatable shaft 14. Therefore, a dimensional tolerance of the respective components of the blower 10 measured in the fan axial direction DRa is larger than a dimensional tolerance of the respective components of the blower 10 measured in the fan radial direction DRr. Furthermore, an amplitude of the vibrations in the fan axial direction DRa at the time of operating the blower 10 is larger than an amplitude of the vibrations in the fan radial direction DRr at the time of operating the blower 10. Therefore, if the shortest distance h1 of the gap G1 is set to be small in order to reduce the backflow, the shroud ring 54 may possibly contact the first cover portion 221 in some cases.

In view of the above point, in the blower 10 of the present embodiment, the shortest distance h1 of the gap G1 is set to be larger than the shortest distances a1, b1. Thus, in the blower 10 of the present embodiment, it is possible to limit the contact between the shroud ring 54 and the first cover portion 221, which would be caused by the dimensional tolerance of the respective components in the fan axial direction DRa at the time of manufacturing of the blower 10 and/or the vibrations in the fan axial direction DRa at the time of operating the blower 10.

Furthermore, at the time of operating the blower 10, a centrifugal force is exerted at the fan 18. Therefore, the fan 18 is deformed toward the outer side in the fan radial direction DRr. When the fan 18 is deformed in this way, the shortest distance a1 is reduced. Therefore, if the size of the gap G1 is set to satisfy the relationship of a1<b1 to reduce the shortest distance a1 for the purpose of reducing the backflow, the shroud ring 54 may possibly contact the first cover portion 221 in some cases.

With respect to the above points, in the blower 10 of the present embodiment, the size of the gap G1 is set to satisfy the relationship of b1<a1. Therefore, even when the shortest distance b1 is set to be small in order to reduce the backflow, it is possible to limit the contact of the shroud ring 54 to the first cover portion 221.

Thus, in the blower 10 of the present embodiment, it is possible to reduce the flow rate of the backflow FL1 while limiting the contact between the shroud ring 54 and the first cover portion 221 in the fan axial direction DRa and the fan radial direction DRr.

Furthermore, in the blower 10 of the present embodiment, the blade front edge part 523 of each of the blades 52 is located on the inner side of both of the ring inner peripheral end part 541 and the boss outer peripheral end part 563 in the fan radial direction DRr. Specifically, in the blower 10 of the present embodiment, the blade front edge part 523 is further inwardly placed in the fan radial direction DRr in comparison to the blower J10 of the first comparative example.

In this way, as shown in FIG. 7, the main flow FL2 can be accelerated with the blade 52 on the upstream side of the merging location, at which the backflow FL1 merges the main flow FL2. Thus, the backflow FL1 of the air, which is discharged from the gap G1, can be redirected to flow along the ring guide surface 543. Therefore, in the blower 10 of the present embodiment, it is possible to limit the separation of the main flow FL2 from the shroud ring by setting the position of the blade front edge part 523 in the above-described manner.

Second Embodiment

Figure 8:
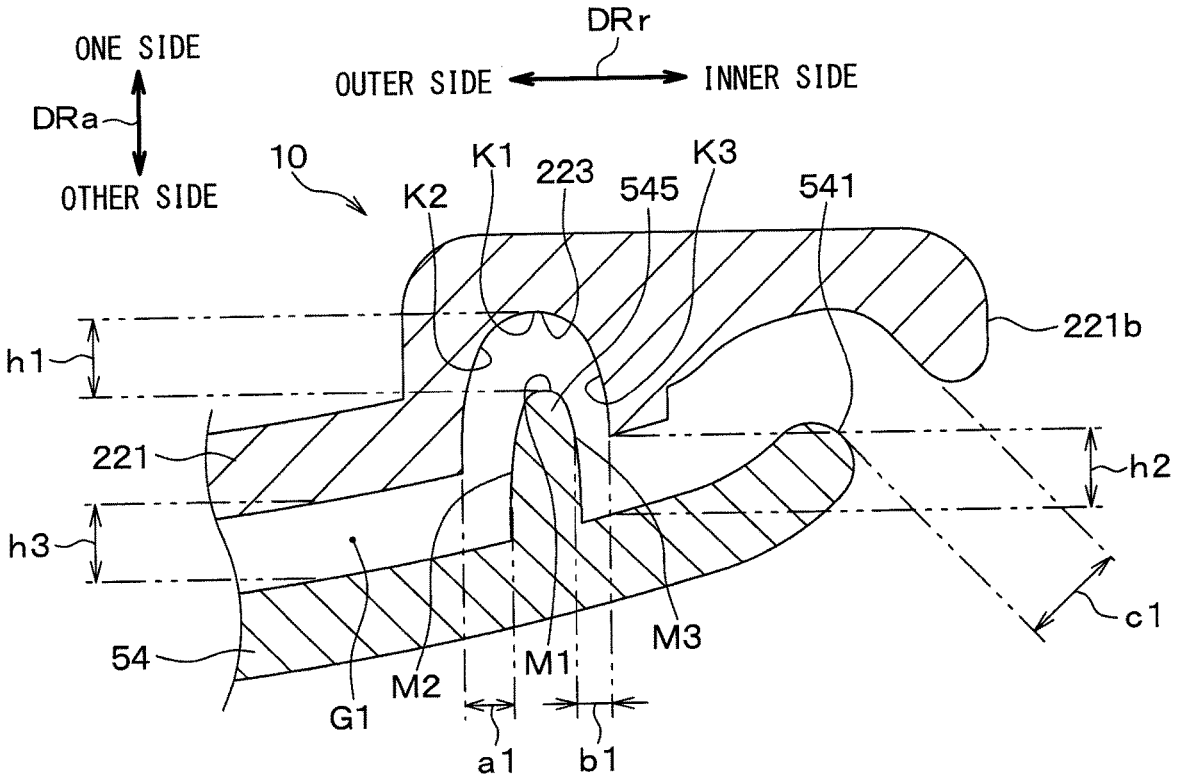
FIG. 8 is an enlarged cross-sectional view of a first cover portion and a shroud ring of a centrifugal blower according to a second embodiment.

As shown in FIG. 8, the blower 10 of the present embodiment is a modification where the surface configuration of the projection 545 and the surface configuration of the recess 223 of the blower 10 of the first embodiment are changed.

In the blower 10 of the present embodiment, a cross section of the surface of the recess 223 is shaped into an arcuate form. The recess 223 includes a bottom part K1, an outer peripheral surface K2 and an inner peripheral surface K3. The bottom part K1 is a part of the recess 223, which is closest to the one side in the fan axial direction DRa in comparison to the rest of the recess 223. The outer peripheral surface K2 is a radially outer surface part of the surface of the recess 223, which is located on the radially outer side of the bottom part K1 in the fan radial direction DRr. The inner peripheral surface K3 is a radially inner surface part of the surface of the recess 223, which is located on the radially inner side of the bottom part K1 in the fan radial direction DRr. The cross section of the bottom part K1 is shaped into a point form. A cross section of the outer peripheral surface K2 and a cross section of the inner peripheral surface K3 are respectively shaped into a curved line form.

A cross section of the surface of the projection 545 is shaped into an arcuate form. The projection 545 includes a top part M1, an outer peripheral surface M2 and an inner peripheral surface M3. The top part E1 is a part of the projection 545, which is closest to the one side in the fan axial direction DRa in comparison to the rest of the projection 545. The outer peripheral surface M2 is a radially outer surface part of the surface of the projection 545, which is located on the radially outer side of the top part M1 in the fan radial direction DRr. The inner peripheral surface M3 is a radially inner surface part of the surface of the projection 545, which is located on the radially inner side of the top part M1 in the fan radial direction DRr. The cross section of the top part M1 is shaped into a point form. A cross section of the outer peripheral surface M2 and a cross section of the inner peripheral surface M3 are respectively shaped into a curved line form.

Similar to the blower 10 of the first embodiment, the blower 10 of the present embodiment has the gap G1 that satisfies the relational equations (1), (2).

$$b1<a1<h1 \quad \text{Equation (1)}$$

$$b1<h2<c1 \quad \text{Equation (2)}$$

Here, the reference sign a1 indicates a shortest distance between the outer peripheral surface M2 of the projection 545 and the outer peripheral surface K2 of the recess 223. In other words, the reference sign a1 indicates an outer shortest distance. The reference sign b1 indicates a shortest distance between the inner peripheral surface M3 of the projection 545 and the inner peripheral surface K3 of the recess 223. In other words, the reference sign b1 indicates an inner shortest distance. The reference sign h1 indicates a shortest distance between the top part M1 of the projection 545 and the surface of the recess 223 in the fan axial direction DRa. In other words, the reference sign h1 indicates a shortest distance between the surface of the projection 545 and the surface of the recess 223 in the fan axial direction DRa.

Therefore, even in the blower 10 of the present embodiment, the advantages, which are similar to those of the first embodiment, can be achieved.

Third Embodiment

Figure 9:
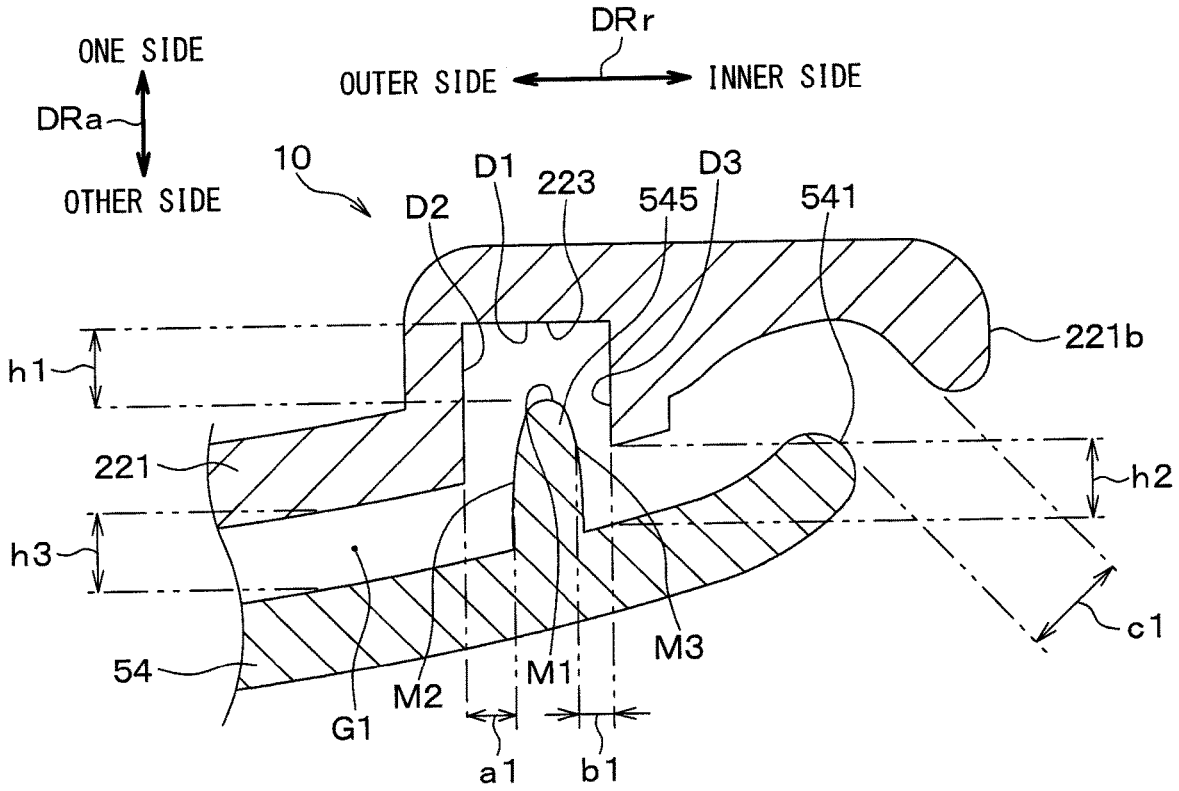
FIG. 9 is an enlarged cross-sectional view of a first cover portion and a shroud ring of a centrifugal blower according to a third embodiment.

As shown in FIG. 9, the blower 10 of the present embodiment is a modification where the surface configuration of the projection 545 of the blower 10 of the first embodiment is changed.

In the blower 10 of the present embodiment, a cross section of the surface of the projection 545 is shaped into an arcuate form like the blower 10 of the second embodiment. Furthermore, similar to the blower 10 of the first embodiment, a cross section of each of the bottom surface D1, the outer peripheral surface D2 and the inner peripheral surface D3 of the recess 223 is shaped into a linear form.

Similar to the blower 10 of the first embodiment, the blower 10 of the present embodiment has the gap G1 that satisfies the relational equations (1), (2).

$$b1<a1<h1 \quad \text{Equation (1)}$$

$$b1<h2<c1 \quad \text{Equation (2)}$$

Here, the reference sign a1 indicates a shortest distance between the outer peripheral surface M2 of the projection 545 and the outer peripheral surface D2 of the recess 223. In other words, the reference sign a1 indicates an outer shortest distance. The reference sign b1 indicates a shortest distance between the inner peripheral surface M3 of the projection 545 and the inner peripheral surface D3 of the recess 223. In other words, the reference sign b1 indicates an inner shortest distance. The reference sign h1 indicates a shortest distance between the top part M1 of the projection 545 and the bottom surface D1 of the recess 223 in the fan axial direction DRa. In other words, the reference sign h1 indicates a shortest distance between the surface of the projection 545 and the surface of the recess 223 in the fan axial direction DRa.

Therefore, even in the blower 10 of the present embodiment, the advantages, which are similar to those of the first embodiment, can be achieved.

Fourth Embodiment

Figure 10:
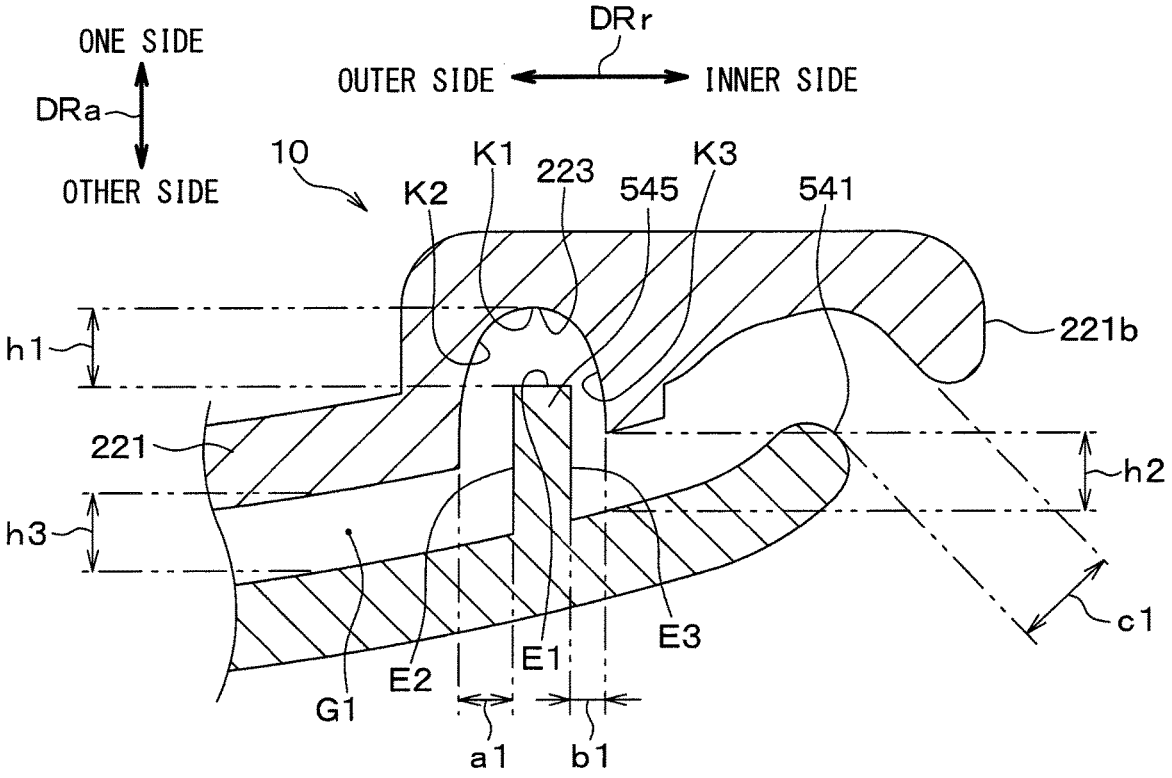
FIG. 10 is an enlarged cross-sectional view of a first cover portion and a shroud ring of a centrifugal blower according to a fourth embodiment.

As shown in FIG. 10, the blower 10 of the present embodiment is a modification where the surface configuration of the recess 223 of the blower 10 of the first embodiment is changed.

In the blower 10 of the present embodiment, a cross section of the surface of the recess 223 is shaped into an arcuate form like the blower 10 of the second embodiment. Furthermore, similar to the blower 10 of the first embodiment, a cross section of each of the top part E1, the outer peripheral surface E2 and the inner peripheral surface E3 of the projection 545 is shaped into a linear form.

Similar to the blower 10 of the first embodiment, the blower 10 of the present embodiment has the gap G1 that satisfies the relational equations (1), (2).

$$b1<a1<h1 \quad \text{Equation (1)}$$

$$b1<h2<c1 \quad \text{Equation (2)}$$

Here, the reference sign a1 indicates a shortest distance between the outer peripheral surface E2 of the projection 545 and the outer peripheral surface K2 of the recess 223. In other words, the reference sign a1 indicates an outer shortest distance. The reference sign b1 indicates a shortest distance between the inner peripheral surface E3 of the projection 545 and the inner peripheral surface K3 of the recess 223. In other words, the reference sign b1 indicates an inner shortest distance. The reference sign h1 indicates a shortest distance between the top part E1 of the projection 545 and the surface of the recess 223 in the fan axial direction DRa. In other words, the reference sign h1 indicates a shortest distance between the surface of the projection 545 and the surface of the recess 223 in the fan axial direction DRa.

Therefore, even in the blower 10 of the present embodiment, the advantages, which are similar to those of the first embodiment, can be achieved.

Fifth Embodiment

Figure 11:
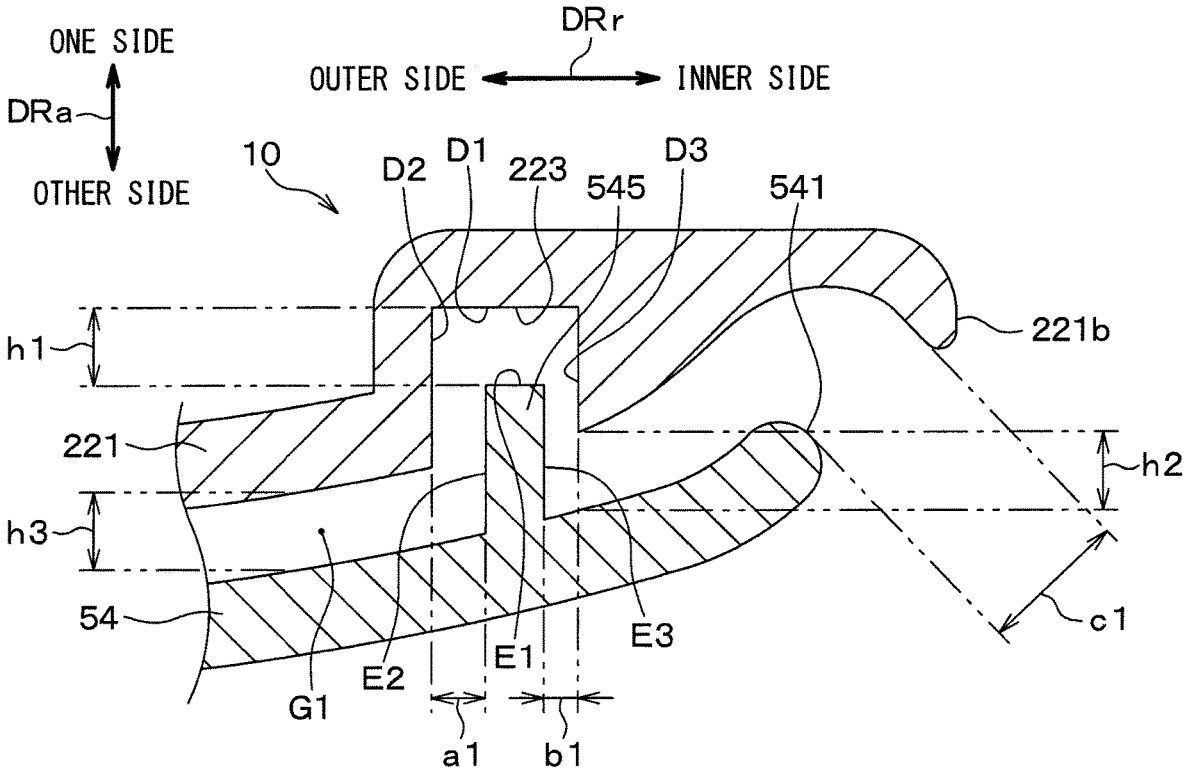
FIG. 11 is an enlarged cross-sectional view of a first cover portion and a shroud ring of a centrifugal blower according to a fifth embodiment.

As shown in FIG. 11, the blower 10 of the present embodiment is similar to the blower 10 of the first embodiment with respect to that the gap G1 is formed to satisfy the relational equations (1), (2), (3).

The blower 10 of the present embodiment differs from the blower 10 of the first embodiment with respect to the size of the gap G1 in a range from the outlet of the labyrinthine structure to the ring inner peripheral end part 541. Specifically, the size of the gap G1 is progressively increased from the outlet of the labyrinthine structure toward the ring inner peripheral end part 541. Specifically, the size of the gap G1 is progressively increased from the outlet of the labyrinthine structure toward the ring inner peripheral end part 541 from the shortest distance h2 at the outlet of the labyrinthine structure to the shortest distance c1 at the ring inner peripheral end part 541.

Similar to the blower 10 of the first embodiment, the blower 10 of the present embodiment has the gap G1 that satisfies the relational equations (1), (2).

Sixth Embodiment

Figure 12:
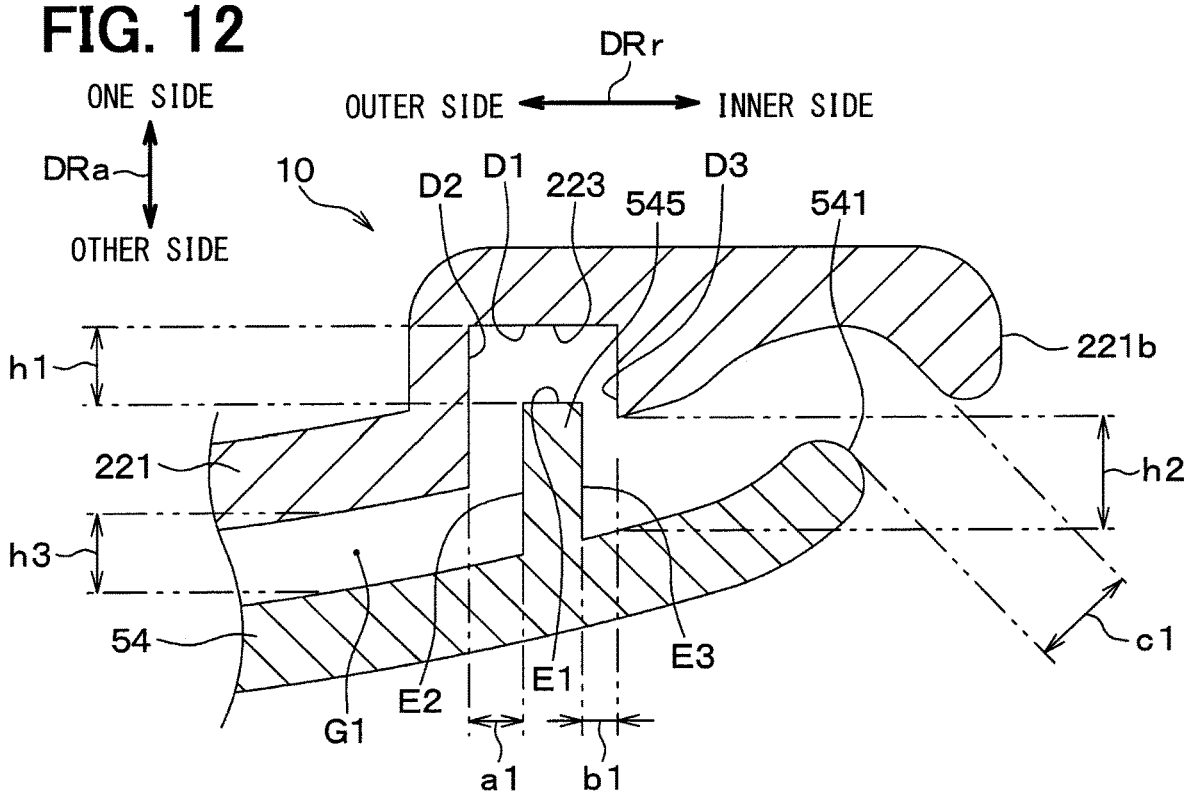
FIG. 12 is an enlarged cross-sectional view of a first cover portion and a shroud ring of a centrifugal blower according to a sixth embodiment.

As shown in FIG. 12, the blower 10 of the present embodiment is similar to the blower 10 of the first embodiment with respect to that the gap G1 is formed to satisfy the relational equation (1).

$$b1<a1<h1 \quad \text{Equation (1)}$$

The blower 10 of the present embodiment differs from the blower 10 of the first embodiment with respect to that the gap G1 is formed to satisfy the relational equations (4), (5).

$$b1<h2=c1 \quad \text{Equation (4)}$$

$$h1=h3<h2 \quad \text{Equation (5)}$$

That is, in the blower 10 of the present embodiment, the size of the gap G1 is minimized in the forming range R1 of the labyrinthine structure. Furthermore, the size of the gap G1 is maximized in the entire range from the outlet of the labyrinthine structure to the discharge outlet of the backflow.

Similar to the blower 10 of the first embodiment, the blower 10 of the present embodiment has the gap G1 that satisfies the relationship of b1<c1, so that it is possible to achieve the advantages, which are similar to the advantages of the blower 10 of the first embodiment.

Seventh Embodiment

Figure 13:
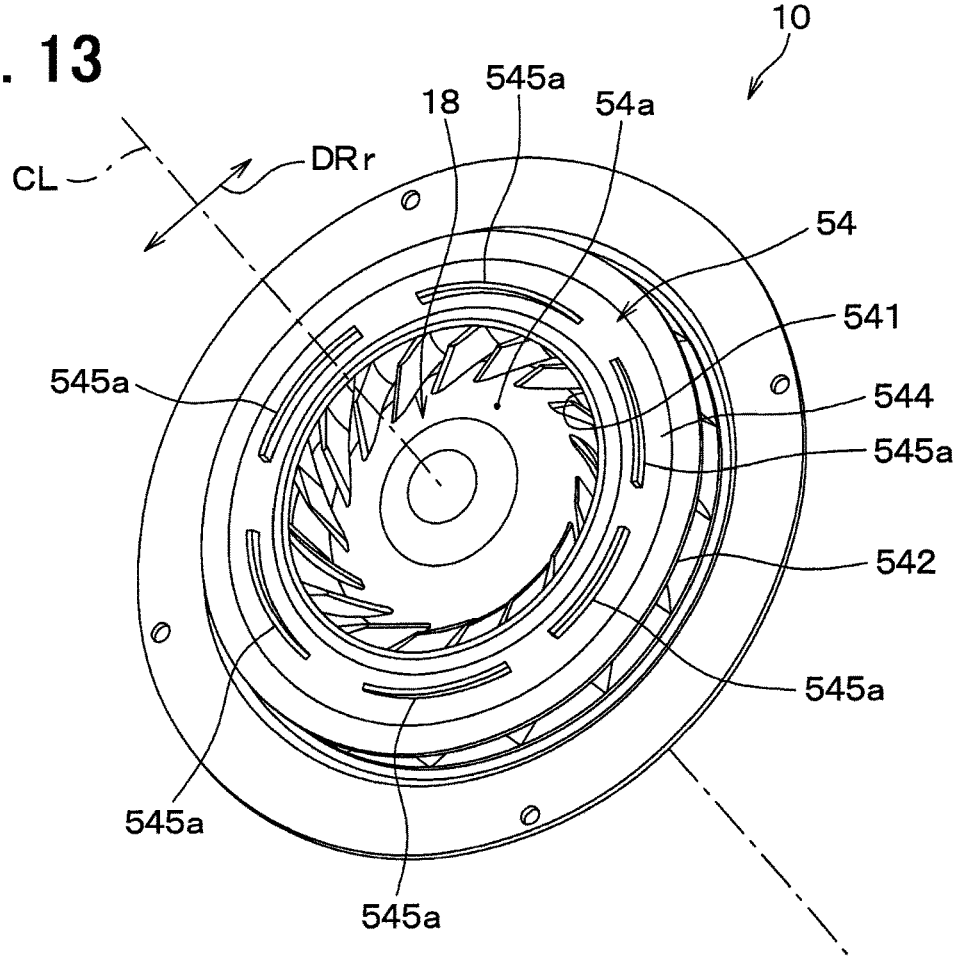
FIG. 13 is a perspective view of a centrifugal blower according to a seventh embodiment in a state where a first case member is removed.

As shown in FIG. 13, the blower 10 of the present embodiment is a modification where the projection 545 of the blower 10 of the first embodiment is changed to a plurality of projections 545*a*.

The projections 545*a* are formed at the ring opposing surface 544. Parts of the ring opposing surface 544, at which the projections 545*a* are formed, are circumferential parts of the ring opposing surface 544, which are opposed to the recess 223 in the fan axial direction DRa. The projections 545*a* are arranged one after another in the circumferential direction about the fan central axis CL. The projections 545*a* respectively extend in the circumferential direction about the fan central axis CL.

A structure of a cross section of the shroud ring 54 and the first cover portion 221, which is taken along a cut plane that extends through the corresponding projection 545*a*, is the same as the structure of the cross section shown in FIGS. 5A and 5B. Therefore, even in the blower 10 of the present embodiment, the advantages, which are similar to those of the blower 10 of the first embodiment, can be achieved.

In the blower 10 of the present embodiment, the projections 545*a*, which are arranged one after another in the circumferential direction, are formed at the region of the ring opposing surface 544, which is opposed to the recess 223 in the fan axial direction DRa. Alternatively, a single projection may be formed in place of the projections 545*a*.

Eighth Embodiment

Figure 14:
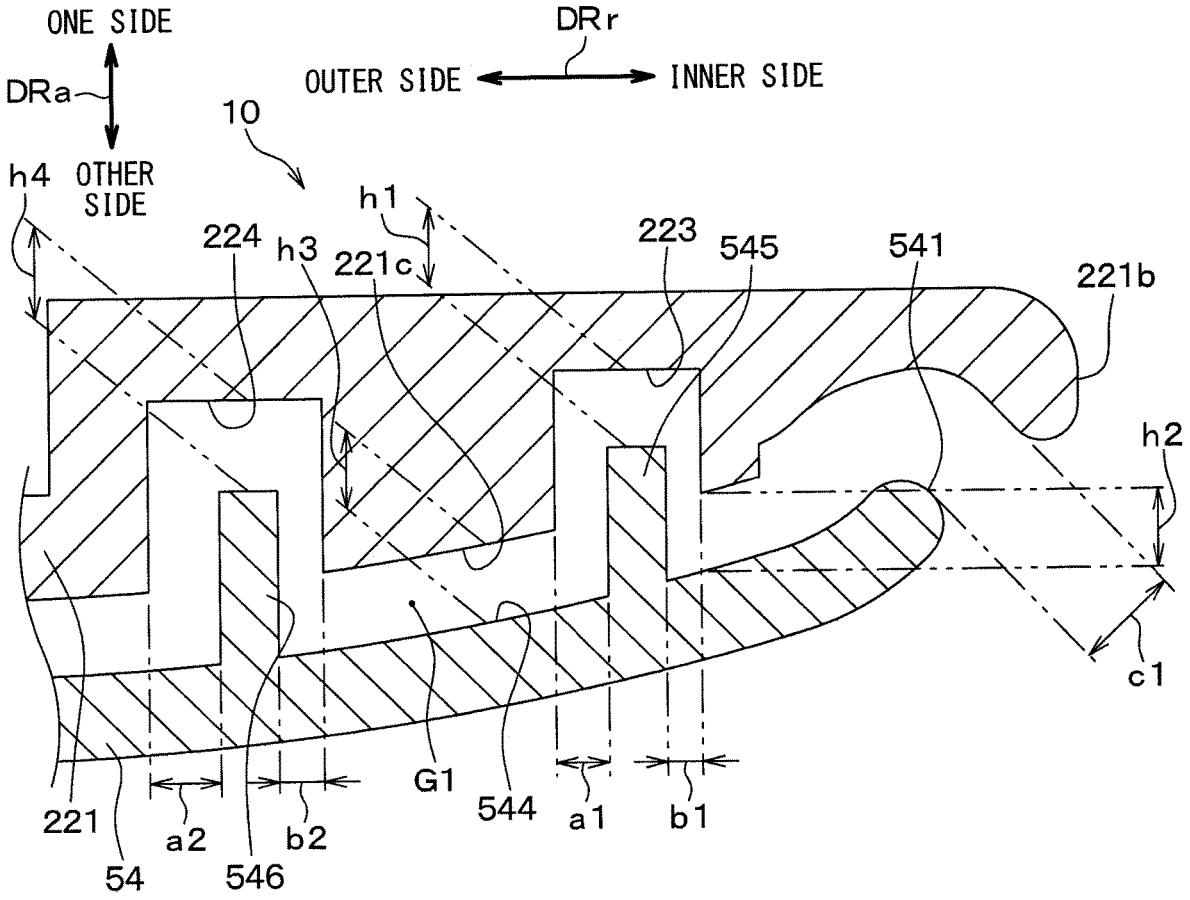
FIG. 14 is an enlarged cross-sectional view of a first cover portion and a shroud ring of a centrifugal blower according to an eighth embodiment.

As shown in FIG. 14, the blower 10 of the present embodiment differs from the blower 10 of the first embodiment with respect to the number of recesses formed at the first cover portion 221.

In the blower 10 of the present embodiment, the first cover portion 221 includes one primary recess 223 and one secondary recess 224, which are formed at the cover opposing surface 221*c*. The shroud ring 54 includes one primary projection 545 and one secondary projection 546, which are formed at the ring opposing surface 544. The primary recess 223 and the primary projection 545 are the same as the recess 223 and the projection 545 of the blower 10 of the first embodiment.

The secondary recess 224 is placed on the radially outer side of the primary recess 223 in the fan radial direction DRr and is shaped in a form of a circle, which has a center positioned at the fan central axis CL. The secondary projection 546 is formed in a region of the ring opposing surface 544, which is opposed to the secondary recess 224 in the fan axial direction DRa. Therefore, the secondary projection 546 is formed along an entire circumferential range of the region of the ring opposing surface 544, which is opposed to the secondary recess 224. Specifically, the secondary projection 546 is shaped in a form of a circle, which has a center positioned at the fan central axis CL.

In the blower 10 of the present embodiment, the gap G1 is formed between the first cover portion 221 and the shroud ring 54 in a state where the primary projection 545 is placed in an inside of the primary recess 223, and the secondary projection 546 is placed in an inside of the secondary recess 224. Similar to the blower 10 of the first embodiment, the gap G1 is formed to satisfy the relational equations (1), (2) and (3). Furthermore, the gap G1 is formed to satisfy the relational equation (6).

$$b2<a2<h4 \qquad \text{Equation (6)}$$

Here, the reference sign a2 indicates a shortest distance between a radially outer surface part of the surface of the secondary projection 546, which is located on the radially outer side in the fan radial direction DRr, and the surface of the secondary recess 224. The reference sign b2 indicates a shortest distance between a radially inner surface part of the surface of the secondary projection 546, which is located on the radially inner side in the fan radial direction DRr, and the surface of the secondary recess 224. The reference sign h4 indicates a shortest distance between the surface of the secondary projection 546 and the surface of the secondary recess 224 in the fan axial direction DRa.

A dimensional relationship between b1 and b2, a dimensional relationship between a1 and a2, and a dimensional relationship between h1 and h4 are as follows. $b1<b2$, $a1<b2$, $h1<h4$ When the number of the labyrinthine structures is increased, the pressure loss of the air is increased at the time of passing through the gap G1. Therefore, in the blower 10 of the present embodiment, the flow rate of the backflow can be further reduced in comparison to the case where the number of the labyrinthine structure is one.

The blower 10 of the present embodiment includes two sets of the recesses and the projections. Here, one recess and one projection placed in the inside of the recess are counted as one set of the recess and the projection. The present disclosure should not be limited to this number. The number of the sets of the recesses and the projections may be three or more.

Furthermore, in the blower 10 of the present embodiment, the primary projection 545 is formed along the entire circumferential range of the region of the ring opposing surface 544, which is opposed to the primary recess 223. However, the present disclosure should not be limited to this configuration. Similar to the blower 10 of the seventh embodiment, a plurality of primary projections 545*a* may be respectively provided to a plurality of parts, which are placed one after another in the circumferential direction in the region that is opposed to the primary recess 223. Furthermore, one primary projection 545*a* may be formed at the region, which is opposed to the primary recess 223.

Similarly, in the blower 10 of the present embodiment, the secondary projection 546 is formed along the entire circumferential range of the region of the ring opposing surface 544, which is opposed to the secondary recess 224. However, the present disclosure should not be limited to this configuration. A plurality of secondary projections may be respectively provided to a plurality of parts, which are placed one after another in the circumferential direction in the region that is opposed to the secondary recess. Furthermore, one secondary projection may be formed at a circumferential part of the region, which is opposed to the secondary recess 224.

Other Embodiments (1) In the blower 10 of the first embodiment, the size of the gap G1 is set to satisfy the relationship of $b1<a1<h1$. However, the present disclosure should not be limited to this setting. The size of the gap G1 may be set to satisfy a relationship of $b1=a1<h1$. Also, the size of the gap G1 may be set to satisfy a relationship of $a1<b1<h1$. In any of these cases, the shortest distance h1 between the projection 545 and the recess 223 in the axial direction is set to be larger than the outer shortest distance a1 and the inner shortest distance b1. Therefore, even in a case where the distance between the projection 545 and the recess 223 in the fan radial direction DRr is reduced to reduce the flow rate of the backflow, it is possible to limit the contact between the shroud ring 54 and the first cover portion 221 in the fan axial direction Dra. Furthermore, from the viewpoint of reducing the flow rate of the backflow, the size of the gap G1 may be set to satisfy a relationship of $b1<h1<a1$.

(2) The size of the gap G1 in the range between the outlet of the labyrinthine structure and the ring inner peripheral end part 541 should not be limited to the description of each of the above embodiments. In the range between the outlet of the labyrinthine structure and the ring inner peripheral end part 541, there may exist a part, in which the size of the gap G1 is smaller than the shortest distance h2.

(3) In the blower 10 of each of the above embodiments, there is used the turbofan 18 that has the fan main body member 50 and the other-end-side plate 60. However, the present disclosure should not be limited to this configuration. A turbofan, which does not have the other-end-side plate 60, may be used as the centrifugal fan. A sirocco fan may be used as the centrifugal fan.

(4) The blower 10 of each of the above embodiments is used at the seat air conditioning device of the vehicle. However, the application of the blower 10 should not be limited to this application. The blower 10 may be applied to an air conditioning device or a cooling device, which is other than the seat air conditioning device.

The present disclosure should not be limited to the above embodiments, and the above embodiments may be modified in various appropriate ways within a scope of the claims and may cover various modifications and variations within a range of equivalents. The above embodiments are not necessarily unrelated to each other and can be combined in any appropriate combination unless such a combination is obviously impossible. The constituent element(s) of each of the above embodiments is/are not necessarily essential unless it is specifically stated that the constituent element(s) is/are essential in the above embodiment, or unless the constituent element(s) is/are obviously essential in principle. Furthermore, in each of the above embodiments, in the case where the number of the constituent element(s), the value, the amount, the range, and/or the like is specified, the present disclosure is not necessarily limited to the number of the constituent element(s), the value, the amount, the range and/or the like specified in the embodiment unless the number of the constituent element(s), the value, the amount, the range and/or the like is indicated as indispensable or is obviously indispensable in view of the principle of the present disclosure. Furthermore, in each of the above embodiments, in the case where the material, the shape and/or the positional relationship of the constituent element (s) are specified, the present disclosure is not necessarily limited to the material, the shape and/or the positional relationship of the constituent element(s) unless the embodiment specifically states that the material, the shape and/or the positional relationship of the constituent element(s) is/are necessary or is/are obviously essential in principle.

SUMMARY

According to a first aspect of some or all of the above embodiments, the centrifugal blower includes: the centrifugal fan, which includes the shroud ring; and the case, which includes the cover portion. The cover portion includes: the cover opposing surface that is opposed to the shroud ring; and the recess that is formed in the cover opposing surface and is shaped in the form of the circle, which has the center positioned at the fan central axis. The shroud ring includes: the ring opposing surface that is opposed to the cover portion; and the at least one projection that is formed in at least the part of the region of the ring opposing surface, which is opposed to the recess. The gap is formed between the cover portion and the shroud ring in the state where the projection is placed in the inside of the recess. The shortest distance between the radially inner end part of the shroud ring and the cover portion is set to be larger than the shortest distance between the surface of the projection and the surface of the recess.

Furthermore, according to a second aspect, the outer shortest distance and the inner shortest distance are both set to be smaller than the shortest distance between the surface of the projection and the surface of the recess in the axial direction. The outer shortest distance is the shortest distance between the radially outer surface part of the surface of the projection and the surface of the recess. The inner shortest distance is the shortest distance between the radially inner surface part of the surface of the projection and the surface of the recess.

It is conceivable to reduce the shortest distance between the projection and the recess in the axial direction to reduce the flow rate of the backflow that passes through the gap. However, in such a case, the shroud ring and the cover portion may possibly contact with each other due to the dimensional tolerance of the respective components in the axial direction at the time of manufacturing of the centrifugal blower and/or the vibrations in the axial direction at the time of operating the centrifugal blower.

In view of this point, in this centrifugal blower, the shortest distance between the projection and the recess in the axial direction is set to be larger than the outer shortest distance and the inner shortest distance, which are the distances between the projection and the recess in the radial direction. Therefore, even in the case where the distance between the projection and the recess in the radial direction is reduced to reduce the flow rate of the backflow, it is possible to limit the contact between the shroud ring and the cover portion in the axial direction. Therefore, in this centrifugal blower, the flow rate of the backflow can be reduced while limiting the contact between the cover portion and the shroud ring in the axial direction.

Furthermore, according to a third aspect, the outer shortest distance is set to be smaller than the shortest distance between the surface of the projection and the surface of the recess in the axial direction. The inner shortest distance is set to be smaller than the outer shortest distance. The outer shortest distance is the shortest distance between the radially outer surface part of the surface of the projection and the surface of the recess. The inner shortest distance is the shortest distance between the radially inner surface part of the surface of the projection and the surface of the recess.

In this centrifugal blower, the shortest distance between the projection and the recess in the axial direction is set to be larger than the outer shortest distance and the inner shortest distance, which are the distances between the projection and the recess in the radial direction. Therefore, similar to the centrifugal blower of the second aspect, even in the case where the distance between the projection and the recess in the radial direction is reduced to reduce the flow rate of the backflow, it is possible to limit the contact between the shroud ring and the cover portion in the axial direction.

Here, at the time of operating the centrifugal blower, the centrifugal force is exerted at the centrifugal fan. Therefore, the centrifugal fan is deformed toward the outer side in the radial direction. By this deformation, the outer shortest distance is reduced. Therefore, in the case where the outer shortest distance is reduced in comparison to the inner shortest distance, and the outer shortest distance is reduced to reduce the backflow, the shroud ring may possibly contact the cover.

With respect to this point, in this centrifugal blower, the inner shortest distance is set to be smaller than the outer shortest distance. Therefore, even when the inner shortest distance is set to be small in order to reduce the backflow, it is possible to limit the contact of the shroud ring to the cover, which would be caused by the centrifugal force. Therefore, in this centrifugal blower, the flow rate of the backflow can be reduced while limiting the contact between the cover portion and the shroud ring in the axial direction and the radial direction.

According to a fourth aspect, the projection is formed along the entire circumferential range of the region, which is opposed to the recess. Thereby, the greater advantage can be achieved in comparison to the case where the projection is formed only at the part of the region that is opposed to the recess.

Furthermore, according to a fifth aspect, the recess is the primary recess. The projection is the primary projection. The cover portion includes the secondary recess that is placed on the radially outer side of the primary recess and is shaped in the form of the circle, which has the center positioned at the fan central axis. The shroud ring includes at least one secondary projection that is formed in at least the part of the region of the ring opposing surface, which is opposed to the secondary recess. The secondary projection is placed in the inside of the secondary recess.

When the number of the labyrinthine structures formed in the gap G1 is increased, the pressure loss of the air is increased at the time of passing through the gap. Therefore, in this centrifugal blower, the flow rate of the backflow can be further reduced in comparison to the case where the number of the labyrinthine structure is one.

According to a sixth aspect, the secondary projection is formed along the entire circumferential range of the region, which is opposed to the secondary recess. Thereby, the greater advantage can be achieved in comparison to the case where the secondary projection is formed only at the part of the region that is opposed to the secondary recess.

Furthermore, according to a seventh aspect, the centrifugal fan includes the fan boss portion that is connected to the other part of each of the plurality of blades located on the opposite side, which is opposite from the one side in the axial direction, and the fan boss portion is supported rotatably about the fan central axis relative to the case. The centrifugal fan includes the other-end-side plate that is joined to the other part of each of the plurality of blades located on the opposite side in the axial direction in the state where the other-end-side plate is fitted to the radially outer side of the fan boss portion. Each of the plurality of blades includes the blade front edge part on the upstream side in the flow direction of the air, which flows between the corresponding adjacent two of the plurality of blades after passing through the suction hole. The blade front edge part of each of the plurality of blades is placed on the radially inner side of both of the radially inner end part of the shroud ring and the radially outer end part of the fan boss portion.

Furthermore, according to an eighth aspect, the centrifugal fan includes the fan boss portion that is connected to the other part of each of the plurality of blades located on the opposite side, which is opposite from the one side in the axial direction, and the fan boss portion is supported rotatably about the fan central axis relative to the case. The centrifugal fan includes the other-end-side plate that is joined to the other part of each of the plurality of blades located on the opposite side in the axial direction in the state where the other-end-side plate is fitted to the radially outer side of the fan boss portion. The radially outer end part of the fan boss portion is located on the radially inner side of the radially inner end part of the shroud ring. Each of the plurality of blades includes the blade front edge part on the upstream side in the flow direction of the air, which flows between the corresponding adjacent two of the plurality of blades after passing through the suction hole. The blade front edge part of each of the plurality of blades extends radially inwardly from the radially inner end part of the shroud ring and is joined to the part of the fan boss portion, which is located on the radially inner side of the radially outer end part of the fan boss portion.

According to the seventh and eighth aspects, the main flow can be accelerated with the blade on the upstream side of the merging location, at which the backflow merges the main flow. Thus, the backflow of the air can be redirected to flow along the shroud ring. Therefore, in the centrifugal blower, it is possible to limit the separation of the main flow of the fan from the shroud ring.

What is claimed is:

1. A centrifugal blower, in which a centrifugal fan is rotatable about a fan central axis to suction air in an axial direction of the fan central axis and discharge the suctioned air in a radial direction of the fan central axis, the centrifugal blower comprising:

the centrifugal fan includes:

a plurality of blades that are circumferentially arranged one after another about the fan central axis; and a shroud ring that is shaped into a plate form and is connected to a part of each of the plurality of blades located on one side in the axial direction, wherein the shroud ring includes a fan suction hole that is configured to suction the air; and a case that receives the centrifugal fan and has a case suction hole that is located on the one side in the axial direction and is configured to suction the air, wherein:

the case includes a cover portion that covers a surface of the shroud ring, which is located on the one side in the axial direction;

the cover portion includes:

a cover opposing surface that is opposed to the shroud ring; and a recess that is formed in the cover opposing surface and is shaped in a form of a circle, which has a center positioned at the fan central axis;

the shroud ring includes:

a ring opposing surface that is opposed to the cover portion; and at least one projection that is formed in at least a part of a region of the ring opposing surface, which is opposed to the recess;

a gap is formed between the cover portion and the shroud ring in a state where the at least one projection is placed in an inside of the recess;

a shortest distance between a radially inner end part of the shroud ring and the cover portion is set to be larger than a shortest distance between a surface of the at least one projection and a surface of the recess;

an outer shortest distance is defined as a shortest distance between a radially outer surface part of the surface of the at least one projection and the surface of the recess in the radial direction and is set to be smaller than a shortest distance between the surface of the at least one projection and the surface of the recess in the axial direction; and an inner shortest distance is defined as a shortest distance between a radially inner surface part of the surface of the at least one projection and the surface of the recess in the radial direction and is set to be smaller than the outer shortest distance.

2. The centrifugal blower according to claim 1, wherein the at least one projection is formed along an entire circumferential range of the region, which is opposed to the recess.

3. The centrifugal blower according to claim 1, wherein:

the recess is a primary recess, and the at least one projection is at least one primary projection;

the cover portion includes a secondary recess that is formed in the cover opposing surface and is shaped in a form of a circle, which has a center positioned at the fan central axis while the secondary recess is located on a radially outer side of the primary recess;

the shroud ring includes at least one secondary projection that is formed in at least a part of a region of the ring opposing surface, which is opposed to the secondary recess; and the at least one secondary projection is placed in an inside of the secondary recess.

4. The centrifugal blower according to claim 3, wherein the at least one secondary projection is formed along an entire circumferential range of the region, which is opposed to the secondary recess.

5. The centrifugal blower according to claim 1, wherein:

the centrifugal fan includes:

a fan boss portion that is connected to another part of each of the plurality of blades located on an opposite side, which is opposite from the one side in the axial direction, wherein the fan boss portion is supported rotatably about the fan central axis relative to the case; and an other-end-side plate that is joined to the another part of each of the plurality of blades located on the opposite side in the axial direction in a state where the other-end-side plate is fitted to a radially outer side of the fan boss portion; and each of the plurality of blades includes a blade front edge part on an upstream side in a flow direction of the air, which flows between adjacent two of the plurality of blades after passing through the fan suction hole; and the blade front edge part of each of the plurality of blades is placed on a radially inner side of both of the radially inner end part of the shroud ring and a radially outer end part of the fan boss portion.

6. The centrifugal blower according to claim 1, wherein:

the centrifugal fan includes:

a fan boss portion that is connected to another part of each of the plurality of blades located on an opposite side, which is opposite from the one side in the axial direction, wherein the fan boss portion is supported rotatably about the fan central axis relative to the case; and an other-end-side plate that is joined to the another part of each of the plurality of blades located on the opposite side in the axial direction in a state where the other-end-side plate is fitted to a radially outer side of the fan boss portion; and a radially outer end part of the fan boss portion is located on a radially inner side of the radially inner end part of the shroud ring;

each of the plurality of blades includes a blade front edge part on an upstream side in a flow direction of the air, which flows between adjacent two of the plurality of blades after passing through the fan suction hole; and the blade front edge part of each of the plurality of blades extends radially inwardly from the radially inner end part of the shroud ring and is connected to a part of the fan boss portion, which is located on a radially inner side of the radially outer end part of the fan boss portion.

* * * * *